US009545655B2

(12) United States Patent
Riley et al.

(10) Patent No.: US 9,545,655 B2
(45) **Date of Patent: *Jan. 17, 2017**

(54) CAN MANUFACTURE

(75) Inventors: Jonathan Riley, Oxfordshire (GB); Alain Presset, Oxfordshire (GB); Stuart Monro, Oxfordshire (GB); Keith Vincent, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 312 days.

This patent is subject to a terminal disclaimer.

(21) Appl. No.: 13/577,172

(22) PCT Filed: Feb. 4, 2011

(86) PCT No.: PCT/EP2011/051666

§ 371 (c)(1),
(2), (4) Date: Aug. 3, 2012

(87) PCT Pub. No.: WO2011/095595

PCT Pub. Date: Aug. 11, 2011

(65) Prior Publication Data

US 2012/0305557 A1 Dec. 6, 2012

(30) Foreign Application Priority Data

Feb. 4, 2010 (EP) ..... 10152593
Apr. 12, 2010 (EP) ..... 10159621

(51) Int. Cl.
*B21D 22/24* (2006.01)
*B21D 22/28* (2006.01)

(52) U.S. Cl.
CPC ..... *B21D 22/24* (2013.01); *B21D 22/28* (2013.01)

(58) Field of Classification Search
CPC ..... B21D 22/20; B21D 22/22; B21D 22/24; B21D 22/28; B21D 22/30
See application file for complete search history.

(56) References Cited

U.S. PATENT DOCUMENTS 2,423,708 A 7/1947 Keogh et al.
2,602,411 A 7/1952 Schnell
3,367,533 A 2/1968 Baker
3,561,638 A 2/1971 Morjan
(Continued)

FOREIGN PATENT DOCUMENTS

BE 784904 10/1972
CN 2042821 U 8/1989
(Continued)

OTHER PUBLICATIONS

English Translation of Chinese Patent Application No. 201180016908.6: First Office Action dated May 6, 2014.
(Continued)

*Primary Examiner* — Teresa M Ekiert
(74) *Attorney, Agent, or Firm* — Baker & Hostetler LLP

(57) ABSTRACT

A method and apparatus are disclosed which are suitable for use in the manufacture of two-piece metal containers. In particular, the method and apparatus disclose a way of making cups from metal sheet using a combination of stretching and (re-)drawing operations. The resulting cups have the advantage of reducing the thickness of the base of the cup relative to the ingoing gauge of material.

24 Claims, 20 Drawing Sheets

(56) References Cited

U.S. PATENT DOCUMENTS

| | | | | |
|---|---|---|---|---|
| 3,572,271 | A | 3/1971 | Fraze | |
| 3,593,552 | A | 7/1971 | Fraze | |
| 3,760,751 | A | 9/1973 | Dunn et al. | |
| 3,820,368 | A | 6/1974 | Fakuzuka et al. | |
| 3,855,862 | A | 12/1974 | Moller | |
| 3,904,069 | A | 9/1975 | Toukmanian | |
| 3,979,009 | A | 9/1976 | Walker | |
| 3,998,174 | A | 12/1976 | Saunders | |
| 4,020,670 | A | 5/1977 | Bulso, Jr. et al. | |
| 4,095,544 | A | 6/1978 | Peters et al. | |
| 4,214,471 | A | 7/1980 | Bulso, Jr. et al. | |
| 4,248,076 | A | 2/1981 | Bulso, Jr. et al. | |
| 4,341,321 | A | 7/1982 | Gombas | |
| 4,343,173 | A | 8/1982 | Bulso, Jr. et al. | |
| 4,372,143 | A | 2/1983 | Elert et al. | |
| 4,416,140 | A | 11/1983 | Bulso, Jr. et al. | |
| 4,416,389 | A | 11/1983 | Wilkinson et al. | |
| 4,454,743 | A | 6/1984 | Bulso, Jr. et al. | |
| 4,483,172 | A | 11/1984 | Bulso, Jr. et al. | |
| 4,485,663 | A * | 12/1984 | Gold | B21D 22/22 72/347 |
| 4,535,618 | A | 8/1985 | Bulso, Jr. et al. | |
| 4,541,265 | A | 9/1985 | Dye et al. | |
| 4,685,322 | A | 8/1987 | Clowes | |
| 4,696,177 | A | 9/1987 | Bulso, Jr. et al. | |
| 4,732,031 | A | 3/1988 | Bulso, Jr. et al. | |
| 4,800,743 | A | 1/1989 | Bulso, Jr. et al. | |
| 4,826,382 | A | 5/1989 | Bulso, Jr. et al. | |
| 5,024,077 | A | 6/1991 | Bulso, Jr. et al. | |
| 5,102,002 | A | 4/1992 | Whitley | |
| 5,111,679 | A | 5/1992 | Kobayashi et al. | |
| 5,218,849 | A | 6/1993 | Sieger et al. | |
| 5,394,727 | A | 3/1995 | Diekhoff et al. | |
| 5,487,295 | A | 1/1996 | Diekhoff et al. | |
| 5,522,248 | A | 6/1996 | Diekhoff et al. | |
| 5,605,069 | A | 2/1997 | Jentzsch | |
| 5,630,337 | A | 5/1997 | Werth | |
| 5,689,992 | A | 11/1997 | Saunders et al. | |
| 5,881,593 | A | 3/1999 | Bulso, Jr. et al. | |
| 6,286,705 | B1 | 9/2001 | Mihalov et al. | |
| 6,505,492 | B2 | 1/2003 | Jroski | |
| 7,124,613 | B1 | 10/2006 | McClung | |
| 7,185,525 | B2 | 3/2007 | Werth et al. | |
| 8,490,455 | B2 | 7/2013 | Kubo | |
| 2002/0074867 | A1 | 6/2002 | Matsuura et al. | |
| 2002/0148272 | A1 | 10/2002 | Jroski | |
| 2007/0125147 | A1 | 6/2007 | Hodjat | |
| 2009/0026214 | A1 | 1/2009 | Yuan et al. | |
| 2011/0186465 | A1 | 8/2011 | Riley | |

FOREIGN PATENT DOCUMENTS

| | | | |
|---|---|---|---|
| CN | 1044925 | A | 8/1990 |
| CN | 101232993 | A | 7/2008 |
| CN | 101537900 | | 9/2009 |
| DE | 2625170 | | 12/1977 |
| DE | 10-2007-050580 | A1 | 4/2009 |
| DE | 10-2007-050581 | A1 | 4/2009 |
| DE | 10 2008047848 | | 4/2010 |
| EP | 0425704 | | 5/1991 |
| EP | 0542552 | A1 | 5/1993 |
| GB | 1438207 | | 6/1976 |
| GB | 2103134 | | 2/1983 |
| GB | 2286364 | A | 8/1995 |
| GB | 2316029 | A | 2/1998 |
| JP | 53-14159 | A | 2/1978 |
| JP | 54-61069 | A | 5/1979 |
| JP | 01178325 | | 7/1989 |
| JP | 4147730 | A | 5/1992 |
| JP | 7-232230 | A | 9/1995 |
| JP | 3046217 | B2 | 10/1995 |
| JP | 7-300124 | A | 11/1995 |
| JP | 8033933 | A | 2/1996 |
| JP | 8-71674 | A | 3/1996 |
| JP | 8-267154 | A | 10/1996 |
| JP | 11226684 | A | 8/1999 |
| WO | WO 94/16842 | A1 | 8/1994 |
| WO | WO 02/45882 | | 6/2002 |
| WO | WO 2011/095595 | A1 | 8/2011 |

OTHER PUBLICATIONS

International Patent Application No. PCT/EP2011/051695: International Search Report dated Apr. 7, 2011, 6 pages.

* cited by examiner

CAN MANUFACTURE

CROSS-REFERENCE TO RELATED APPLICATIONS

This application is the National Stage of International Application No. PCT/EP2011/051666, filed Feb. 4, 2011, which claims the benefit of EP application number 10152593.9, filed Feb. 4, 2010, and EP application number 10159621.1, filed Apr. 12, 2010, the disclosures of which are incorporated herein by reference in their entirety.

TECHNICAL FIELD

This invention relates to the production of metal cups and in particular (but without limitation) to metal cups suitable for the production of "two-piece" metal containers.

BACKGROUND ART

U.S. Pat. No. 4,095,544 (NATIONAL STEEL CORPORATION) Jun. 20, 1978 details conventional Draw & Wall Ironing (DWI) and Draw & Re-Draw (DRD) processes for manufacturing cup-sections for use in making two-piece metal containers. [Note that in the United States of America, DWI is instead commonly referred to as D&I]. The term "two-piece" refers to i) the cup-section and ii) the closure that would be subsequently fastened to the open end of the cup-section to form the container.

In a DWI (D&I) process (as illustrated in FIGS. 6 to 10 of U.S. Pat. No. 4,095,544), a flat (typically) circular blank stamped out from a roll of metal sheet is drawn through a drawing die, under the action of a punch, to form a shallow first stage cup. This initial drawing stage does not result in any intentional thinning of the blank. Thereafter, the cup, which is typically mounted on the end face of a close fitting punch or ram, is pushed through one or more annular wall-ironing dies for the purpose of effecting a reduction in thickness of the sidewall of the cup, thereby resulting in an elongation in the sidewall of the cup. By itself, the ironing process will not result in any change in the nominal diameter of the first stage cup.

FIG. 1 shows the distribution of metal in a container body resulting from a conventional DWI (D&I) process. FIG. 1 is illustrative only, and is not intended to be precisely to scale. Three regions are indicated in FIG. 1:

- Region 1 represents the un-ironed material of the base. This remains approximately the same thickness as the ingoing gauge of the blank, i.e. it is not affected by the separate manufacturing operations of a conventional DWI process.
- Region 2 represents the ironed mid-section of the sidewall. Its thickness (and thereby the amount of ironing required) is determined by the performance required for the container body.
- Region 3 represents the ironed top-section of the sidewall. Typically in can making, this ironed top-section is around 50-75% of the thickness of the ingoing gauge.

In a DRD process (as illustrated in FIGS. 1 to 5 of U.S. Pat. No. 4,095,544), the same drawing technique is used to form the first stage cup. However, rather than employing an ironing process, the first stage cup is then subjected to one or more re-drawing operations which act to progressively reduce the diameter of the cup and thereby elongate the sidewall of the cup. By themselves, most conventional re-drawing operations are not intended to result in any change in thickness of the cup material. However, taking the example of container bodies manufactured from a typical DRD process, in practice there is typically some thickening at the top of the finished container body (of the order of 10% or more). This thickening is a natural effect of the re-drawing process and is explained by the compressive effect on the material when re-drawing from a cup of large diameter to one of smaller diameter.

Note that there are alternative known DRD processes which achieve a thickness reduction in the sidewall of the cup through use of small or compound radii draw dies to thin the sidewall by stretching in the draw and re-draw stages.

Alternatively, a combination of ironing and re-drawing may be used on the first stage cup, which thereby reduces both the cup's diameter and sidewall thickness. For example, in the field of the manufacture of two-piece metal containers (cans), the container body is typically made by drawing a blank into a first stage cup and subjecting the cup to a number of re-drawing operations until arriving at a container body of the desired nominal diameter, then followed by ironing the sidewall to provide the desired sidewall thickness and height.

However, DWI (D&I) and DRD processes employed on a large commercial scale have a serious limitation in that they do not act to reduce the thickness (and therefore weight) of material in the base of the cup. In particular, drawing does not result in reduction in thickness of the object being drawn, and ironing only acts on the sidewalls of the cup. Essentially, for known DWI (D&I) and DRD processes for the manufacture of cups for two-piece containers, the thickness of the base remains broadly unchanged from that of the ingoing gauge of the blank. This can result in the base being far thicker than required for performance purposes.

The metal packaging industry is fiercely competitive, with weight reduction being a primary objective because it reduces transportation and raw material costs. By way of example, around 65% of the costs of manufacturing a typical two-piece metal food container derive from raw material costs.

There is therefore a need for improved light-weighting of metal cup-sections in a cost-effective manner. Note that in this document, the terms "cup-section" and "cup" are used interchangeably.

DISCLOSURE OF INVENTION

Accordingly, in a first aspect of the invention there is provided a method for manufacture of a metal cup, the method comprising the following operations:

i. a stretching operation comprising taking a cup having a sidewall and an integral base, the cup formed of metal sheet, clamping an annular region on either or both the sidewall and the base to define an enclosed portion which includes all or part of the base, and deforming and stretching at least some of that part of the base which lies within the enclosed portion to thereby increase the surface area and reduce the thickness of the base, the annular clamping adapted to restrict or prevent metal flow from the clamped region into the enclosed portion during this stretching operation;

ii. a drawing operation comprising drawing the cup to pull and transfer outwardly material of the stretched and thinned base.

For the purpose of this document, the "drawing operation" referred to above is occasionally referred to as the "post-stretch drawing operation" to signify it taking place after the stretching operation.

The method of the invention has the advantage (over known processes) of achieving manufacture of a cup having a base which is thinner than the ingoing gauge of the metal sheet prior to the stretching operation, without requiring loss or waste of metal. When applied to the manufacture of two-piece containers, the invention enables cost savings to be made of the order of several dollars per 1,000 containers relative to existing manufacturing techniques.

The stretching operation is essential to achieve thinning of the base of the cup relative to the ingoing gauge of the metal sheet. The increased surface area of the base resulting from the stretching operation provides "excess material". This "excess material" is pulled and transferred outwardly during the subsequent drawing operation.

Most preferably, the drawing operation is adapted to pull and transfer material of the stretched and thinned base into the sidewall. This has the benefit of increasing both the height of the sidewall and the enclosed volume of the cup. As stated in the description of the Background Art, the sidewall thickness is critical in affecting the performance characteristics of a cup used for a container (can) body. This aspect of the invention has the advantage of transferring material into the performance critical part of the cup (i.e. the sidewall), whilst also minimising the thickness and weight of the cup's base.

To ensure that the base material is stretched and thinned during the stretching operation, the cup is clamped sufficiently to restrict or prevent metal flow from the clamped region into the enclosed portion during the stretching operation. If the clamping loads are insufficient, material from the clamped region (or from outside of the clamped region) would merely be drawn into the enclosed portion (which includes all or part of the base), rather than the enclosed portion (and therefore the base) undergoing any thinning. It has been found that stretching and thinning can still occur when permitting a limited amount of flow of material from the clamped region (or from outside of the clamped region) into the enclosed portion, i.e. when metal flow is restricted rather than completely prevented. The subsequent transfer of the stretched and thinned material of the base outwardly and into the sidewall during the post-stretch drawing operation is better illustrated in the embodiments of the invention shown in the attached drawings (see especially FIGS. 12*c* and 12*d*).

The method of the invention is particularly suitable for use in the manufacture of metal containers, with the final resulting cup being used for the container body. The drawing operation performed on the stretched cup may comprise two or more drawing stages to effect a staged reduction in cup diameter and increase in sidewall height. Further, the cup may also be subjected to an ironing operation to both thin and increase the height of the sidewall, and thereby maximise the enclosed volume of the final resulting cup. The final resulting cup may be formed into a closed container by the fastening of a closure to the open end of the cup. For example, a metal can end may be seamed to the open end of the final resulting cup (see FIG. 15).

The method of the invention is suitable for use on cups that are both round and non-round in plan. However, it works best on round cups.

One way of minimising the amount of material in the base of cup-sections produced using conventional DWI and DRD processes would be to use thinner gauge starting stock. However, tinplate cost per tonne increases as the gauge decreases. This increase is explained by additional costs of rolling, cleaning and tinning the thinner steel. When also taking account of material usage during manufacture of a two-piece container, the variation in net overall cost to manufacture the container versus ingoing gauge of material looks like the graph shown in FIG. 2. This graph demonstrates that from a cost perspective, going for the thinnest gauge material does not necessarily reduce costs. In essence, there is a cheapest gauge of material for any container of a given sidewall thickness. The graph also shows the effect of reducing the thickness of the top and mid-wall sections of the container in driving down the cost curve. FIG. 3 shows the same graph based upon actual data for UK-supplied tinplate of the type commonly used in can-making. For the material illustrated in FIG. 3, 0.285 mm represents the optimum thickness on cost grounds, with the use of thinner gauge material increasing net overall costs for can production. The graph of FIG. 3 shows the percentage increase in overall cost per 1,000 cans when deviating from the 0.285 mm optimum ingoing gauge thickness.

The final resulting cup of the invention has the benefits of a thinner (and therefore lighter) base. Also, dependent on the drawing operation employed, the stretched and thinned material transferred outwardly from the base is able to contribute to maximising the sidewall height. In this way, the invention provides an increased enclosed cup volume for a given amount of metal-relative to known methods of manufacturing cup-sections for two-piece containers. Additionally, the cost of manufacturing each container (on a cost per tonne or unit volume basis) is reduced because the invention allows thicker (and therefore cheaper) ingoing gauge material to be used for the metal sheet used to form the cup.

By clamping an "annular region" is meant that either or both of the sidewall and the base are clamped either continuously or at spaced intervals in an annular manner. Although it is possible to clamp the sidewall alone, rather than the base (see FIG. 9), it is preferred that the annular clamping comprises clamping an annular region on the base of the cup (the enclosed portion then being that part of the base located radially inward of the clamped region) (see FIGS. 6*a* and 6*b*).

Trials have been conducted using a clamping means which comprises a clamping element in the form of an annular ring having a highly polished clamping face pressing against the annular region of the base of the cup. However, it has been found that reduced clamping loads are possible to obtain the same stretching effect when using a clamping element with a clamping face that is textured. The texturing has the effect of roughening the surface of the clamping face and thereby increasing the gripping effect of the clamping element on the annular region of the base for a given clamping load. The textured clamping element is therefore better able to restrict or prevent metal flow from the clamped region during the stretching operation. By way of example, the surface roughening of the clamping face has been induced by subjecting an initially smooth clamping face to electric discharge machining (EDM), which erodes the surface of the clamping face to define a pitted, roughened surface.

In one form, the clamping may conveniently be achieved by clamping opposing surfaces of either or both the sidewall and the base of the cup between corresponding opposing first and second clamping elements, each of the first and second clamping elements having a clamping face free of geometric discontinuities. For example, considering the case of clamping the base of the cup (rather than the sidewall), the first and second clamping elements may conveniently have wholly planar smooth clamping faces. In an alternative example considering the case of clamping the sidewall of a cylindrical shaped cup (rather than the base), the first and second clamping elements may conveniently have correspondingly profiled cylindrical clamping faces. However, it has been found that introducing geometric discontinuities into the opposing clamping faces of the first and second clamping elements provides improved clamping with reduced unwanted slippage or drawing of material during the stretching operation. This has the benefits of reducing the clamping loads required during the stretching operation to achieve a given amount of stretching of the base. By "geometric discontinuities" is meant structural features in the respective clamping faces of the first and second clamping elements which, when the clamping elements are used to clamp opposing surfaces of the metal sheet of the cup, act on the metal to disrupt the flow of metal between the clamping elements as the stretching load is applied.

In one form, the geometric discontinuities may be provided by forming the face of the first clamping element with one or more beads, ridges or steps which, in use, urge metal of the clamped annular region within corresponding one or more relief features provided in the face of the second clamping element. The relief features are conveniently provided as cut-outs or recesses in the clamping face, being shaped and sized to accommodate the corresponding one or more beads, ridges or steps. In use, the first and second clamping elements would clamp the opposing surfaces of the sidewall or the base, with the effect of the one or more beads, ridges or steps and corresponding one or more relief features being to disrupt the flow of the metal sheet of the cup between the first and second clamping elements as the stretching load is applied. This disruption of the flow of metal is what enables the improved clamping effect for a given clamping load over merely clamping the cup between first and second clamping elements having wholly smooth clamping faces. It was found to be beneficial to have sufficient clearance between the one or more beads/ridges/steps and corresponding one or more relief features to avoid pinching or coining of the metal, because this helps to minimise the formation of weak points that would be vulnerable to tearing during the subsequent drawing operation (or any subsequent ironing operation). Significant reductions in clamping loads required for a given amount of stretching were seen when the first and second clamping elements were adapted such that, in use, the one or more beads/ridges/steps urged metal of the clamped annular region so as to be wholly enclosed by and within the corresponding relief feature(s). An example of this clamping configuration is illustrated in the description of the embodiments of the invention (see the embodiment illustrated in FIG. 8*a*).

Although the above paragraph refers to the one or more beads/ridges/steps being located in the face of the first clamping element and the corresponding one or more relief features being located in the face of the second clamping element, the invention is not limited to this. In particular, the one or more beads/ridges/steps may alternatively be located in the face of the second clamping element and corresponding one or more relief features located in the face of the first clamping element. As a further alternative, each of the faces of the first and second clamping elements may comprise a mixture of beads/ridges/steps and corresponding relief features. However, it has been found that providing a single bead/ridge/step and corresponding single relief feature in the clamping face of the respective clamping elements is able to achieve significant reductions in clamping load required for a given amount of stretching (see the embodiments illustrated in FIGS. 7*a* and 8*a*). As indicated in the above paragraph, significant reductions in clamping load were seen when the first and second clamping elements were adapted such that, in use, the bead/ridge/step provided in the clamping face of the first or second clamping element urges metal of the clamped annular region so as to be wholly enclosed by and within the corresponding relief feature in the clamping face of the second or first clamping element (see Table 1 in the description of the embodiments of the invention).

Note that the first and second clamping elements need not be continuous; for example, segmented tooling may be used for each or one of the first and second clamping elements. Expressed another way, each or one of the clamping elements may itself comprise two or more discrete clamping portions which each, in use, act upon a discrete area of the metal sheet of the cup.

Preferably, the stretching operation comprises providing a "stretch" punch and moving either or both of the "stretch" punch and the cup toward each other so that the "stretch" punch deforms and stretches at least some of that part of the base which lies within the enclosed portion.

In its simplest form, the "stretch" punch is a single punch having an end face which, when urged into contact with the base of the cup, both deforms and stretches the base. Preferably, the end face of the "stretch" punch is provided with a non-planar profile, either or both of the "stretch" punch and the cup moved towards each other so that the "stretch" punch deforms and stretches at least some of that part of the base which lies within the enclosed portion into a corresponding non-planar profile. Conveniently, the end face would be provided with a domed or part-spherical profile, which in use acts to stretch and deform at least some of that part of the base which lies within the enclosed portion into a correspondingly domed or part-spherical profile. By way of example, FIG. 4 shows the variation in the base thickness of a stretched cup resulting from use of a single "stretch" punch provided with a domed-profiled end face for a cup of approximately 47.5 mm radius (95 mm diameter). The material had an ingoing gauge thickness of 0.0115 inches (0.29 mm), with the minimum base thickness after the stretching operation being 0.0086 inches (0.22 mm), representing a 25% peak reduction in base thickness. In the example shown, the degree of base thinning resulting from the stretching operation was non-uniform across the diameter of the base. Varying the profile of the end face of the punch has been found to affect the base thickness profile and, in particular, the location of maximum base thinning. By way of example, in vertical section the end face of the punch may have compound radii or be oval in profile. To enable different levels of thinning to be achieved across the enclosed portion, the "stretch" punch preferably comprises an end face having one or more relief features. For example, the end face may include one or more recesses or cut-outs (see FIG. 11).

As an alternative to having a single punch, the "stretch" punch may instead comprise a punch assembly, the assembly comprising a first group of one or more punches opposing one surface of the enclosed portion and a second group of one or more punches opposing the opposite surface of the enclosed portion, the stretching operation comprising moving either or both of the first and second groups towards each other to deform and stretch at least some of that part of the base which lies within the enclosed portion. Such a punch assembly may, for example, allow the enclosed portion to be deformed into an undulating profile, which may allow the enclosed portion to be stretched in a more uniform manner than that shown in FIG. 4 (see the example shown in FIG. 10).

As a further alternative to using either a single punch or a punch assembly, the stretching operation may instead be achieved by spinning. For example, the spinning may comprise use of a profiled tool that is rotatably and/or pivotally mounted, the tool and enclosed portion of the cup being brought into contact with each other, with either or both of the profiled tool and cup being rotated and/or pivoted relative to each other such that the profiled tool progressively profiles and stretches the enclosed portion.

The drawing operation performed on the stretched cup has the benefit of maximising the container height and volume for a given amount of raw material. The drawing operation is conveniently performed by drawing the cup through one or a succession of draw dies, to pull and transfer outwardly material of the stretched and thinned base, preferably into the sidewall. Whether the stretched and thinned material remains wholly within the base or is transferred into the sidewall, the effect is still to provide a cup having a base with a thickness less than the ingoing gauge of the metal sheet. When the stretched and thinned material is pulled and transferred into the sidewall, this has the benefit of both increasing the height of the sidewall and resulting in the base of the drawn cup having a thickness less than the ingoing gauge of the metal sheet.

Taking the example of where the stretching operation has been performed using a punch having an end face with a domed profile to stretch and thin at least some of that part of the base which lies within enclosed portion into a correspondingly domed shape, the effect of the drawing operation (whether consisting of a single or multiple drawing stages) would be to lessen the height of the "dome" as stretched and thinned material of the base is progressively pulled and transferred outwardly. The drawing operation may be sufficient to essentially flatten the stretched and thinned dome; however, this is not a requirement of the invention. For example, in the case of cups intended for use as containers for carbonated beverages (or other pressurised products), such containers commonly have a base that is inwardly-domed for the purpose of resisting pressurisation from the product. Where the cup of the invention is intended for use as such a container, it may be preferable to retain some of the "dome" resulting from the stretching operation. This retention of the dome in the base of the cup may be assisted by the use of a plug, insert or equivalent means located adjacent the enclosed portion during the drawing operation, the plug or insert acting to limit any flattening of the dome during the drawing operation. Where the cup is also subjected to an ironing operation and it is desired to retain some of the "dome", it may be necessary to also use a plug, insert or equivalent means to avoid the back tension resulting from the ironing operation flattening the dome. Alternatively or in addition, it is likely that the cup would undergo a later reforming operation to provide the domed base of the cup with a desired final profile necessary to resist in-can pressure.

The drawing operation may be performed using a body-maker/press having one or a succession of draw dies. Typically, the drawing operation would comprise drawing the cup through one or a succession of draw dies, to draw material of the stretched and thinned base outwardly, and preferably into the sidewall. This would thereby increase the height of the sidewall and result in the base of the drawn cup having a thickness less than the ingoing gauge of the metal sheet.

Preferably, the cup which is fed into the stretching operation is formed by an initial drawing operation performed prior to the stretching operation, the initial drawing operation comprising drawing a metal sheet into a cup profile. In this case, the drawing operation following stretching would be a re-drawing operation.

For this initial drawing operation, preferably a blank is first cut from an expanse of metal sheet, the blank then drawn into a cup profile. Conveniently, the initial drawing operation comprises first slidably clamping the metal sheet at a location between a "draw" die and a "draw" punch, the "draw" punch adapted to move through the draw die, either or both of the "draw" punch and draw die being co-axially moved towards each other so that the "draw" punch draws the metal sheet against the forming surface of the "draw" die to form the cup.

By "slidably clamping" is meant that the clamping load during drawing is selected so as to permit the metal sheet to slide, relative to whatever clamping means is used (e.g. a draw pad), in response to the deforming action of the drawing die on the metal sheet. An intention of this slidable clamping is to prevent or restrict wrinkling of the material during this initial drawing operation. The same principles apply to the (re-)drawing operation that follows the stretching operation.

This initial drawing operation to form the cup may simply be performed in a conventional cupping press using a combination of a "draw" punch and "draw" die. However, the initial drawing operation is not limited to use of a conventional draw punch/draw die arrangement. For example, it may comprise blow-forming using compressed air/gases or liquids to draw the metal sheet against the draw die or a mould into the shape of the cup. Again, these same alternatives may be used to perform the (re-)drawing operation that follows the stretching operation. In essence, the initial drawing and the (re-)drawing operations encompass any means of applying a drawing force.

A second aspect of the invention relates to an apparatus for working the method of the invention. Some of the features of such an apparatus have already been described above. However, for completeness, the apparatus claims are briefly discussed below. The term "apparatus" encompasses not only a single plant item, but also includes a collection of discrete plant items that, collectively, are able to work the claimed method of the invention (e.g. similar to the assembly line of a car plant, with successive operations performed by different items of plant).

According to the second aspect of the invention, there is provided an apparatus for manufacture of a metal cup, the apparatus comprising:

- clamping means for clamping a cup formed of metal sheet, the cup having a sidewall and an integral base, the clamping means adapted to clamp an annular region on either or both the sidewall and the base to define an enclosed portion which includes all or part of the base;
- a stretch tool adapted to deform and stretch at least some of that part of the base which lies within the enclosed portion in a stretching operation to thereby increase the surface area and reduce the thickness of the base, the clamping means further adapted to restrict or prevent metal flow from the clamped region into the enclosed portion during this stretching operation; and
- means for drawing the cup to pull and transfer outwardly material of the stretched and thinned base.

The clamping means may comprise a clamping element in the form of a continuous annular sleeve; alternatively, it may be a collection of discrete clamping element portions distributed in an annular manner to act against either or both of the sidewall and the base.

The clamping means preferably comprises a first clamping element and a second clamping element, the first and second clamping elements adapted to clamp opposing surfaces of either or both the sidewall and the base. The respective clamping faces may have the features discussed in the above paragraphs relating to the method of the invention, i.e. each clamping face being free of geometric discontinuities, or preferably each clamping face provided with geometric discontinuities to provide the benefit of a reduced clamping load for a given amount of stretch of the base of the cup.

As indicated in discussion of the method of the invention, preferably the clamping means is adapted to clamp an annular region on the base of the cup, with the enclosed portion being that part of the base located radially inward of the clamped annular region.

Preferably, the stretch tool comprises a "stretch" punch, the apparatus adapted to move either or both of the "stretch" punch and the cup toward each other so that the "stretch" punch deforms and stretches at least some of that part of the base which lies within the enclosed portion. As indicated in discussion of the method of the invention, the "stretch" punch may simply be a single punch having an end face which, in use, is urged against the enclosed portion of the cup to perform the stretching operation. Trials have been performed using a single punch as the "stretch" punch, the end face of the single punch having a domed or generally part-spherical profile which, in use, stretches the enclosed portion into a correspondingly shaped domed or part-spherical profile. Alternatively, in vertical section the end face of the punch may have compound radii or be oval in profile. To enable different levels of thinning to be achieved across the enclosed portion, the "stretch" punch may preferably comprise an end face having one or more relief features. For example, the end face may include one or more recesses or cut-outs (see FIG. 11).

In an alternative embodiment, the "stretch" punch comprises a punch assembly, the assembly comprising a first group of one or more punches opposing one surface of the enclosed portion and a second group of one or more punches opposing the opposite surface of the enclosed portion, the first and second groups moveable towards each other to, in use, deform and stretch at least some of that part of the base which lies within the enclosed portion (see FIG. 10).

As referred to in discussion of the method of the invention, the drawing operation is conveniently performed by drawing the cup through one or a succession of draw dies, to transfer material from the stretched and thinned base outwardly, and preferably into the sidewall, thereby resulting in the base of the drawn cup having a thickness less than the ingoing gauge of the metal sheet. Where the material is transferred into the sidewall, it also has the effect of increasing the height of the sidewall too. The means for drawing preferably comprises a draw punch (or succession of punches) and corresponding draw die(s).

Preferably, the apparatus further comprises means for initially drawing a metal sheet to form the cup for the stretching operation. Conveniently, the means for initially drawing the metal sheet comprises a "draw" die, a "draw" punch and means for slidably clamping the metal sheet at a location between the "draw" die and the "draw" punch. Where an initial drawing operation is used to form the cup for the stretching operation, the drawing operation following stretching would be a re-drawing operation.

Furthermore, preferably the apparatus further comprises one or a succession of ironing dies to reduce the thickness of the sidewall and thereby increase the height of the sidewall in an ironing operation.

The method and apparatus of the invention are not limited to a particular metal. They are particularly suitable for use with any metals commonly used in DWI (D&I) and DRD processes. Also, there is no limitation on the end use of the cup that results from the method and apparatus of the invention. Without limitation, the cups may be used in the manufacture of any type of container, whether for food, beverage or anything else. However, the invention is particularly beneficial for use in the manufacture of containers for food, especially with regard to the cost savings that can be made relative to known manufacturing techniques.

BRIEF DESCRIPTION OF FIGURES IN THE DRAWINGS

Figure 1:
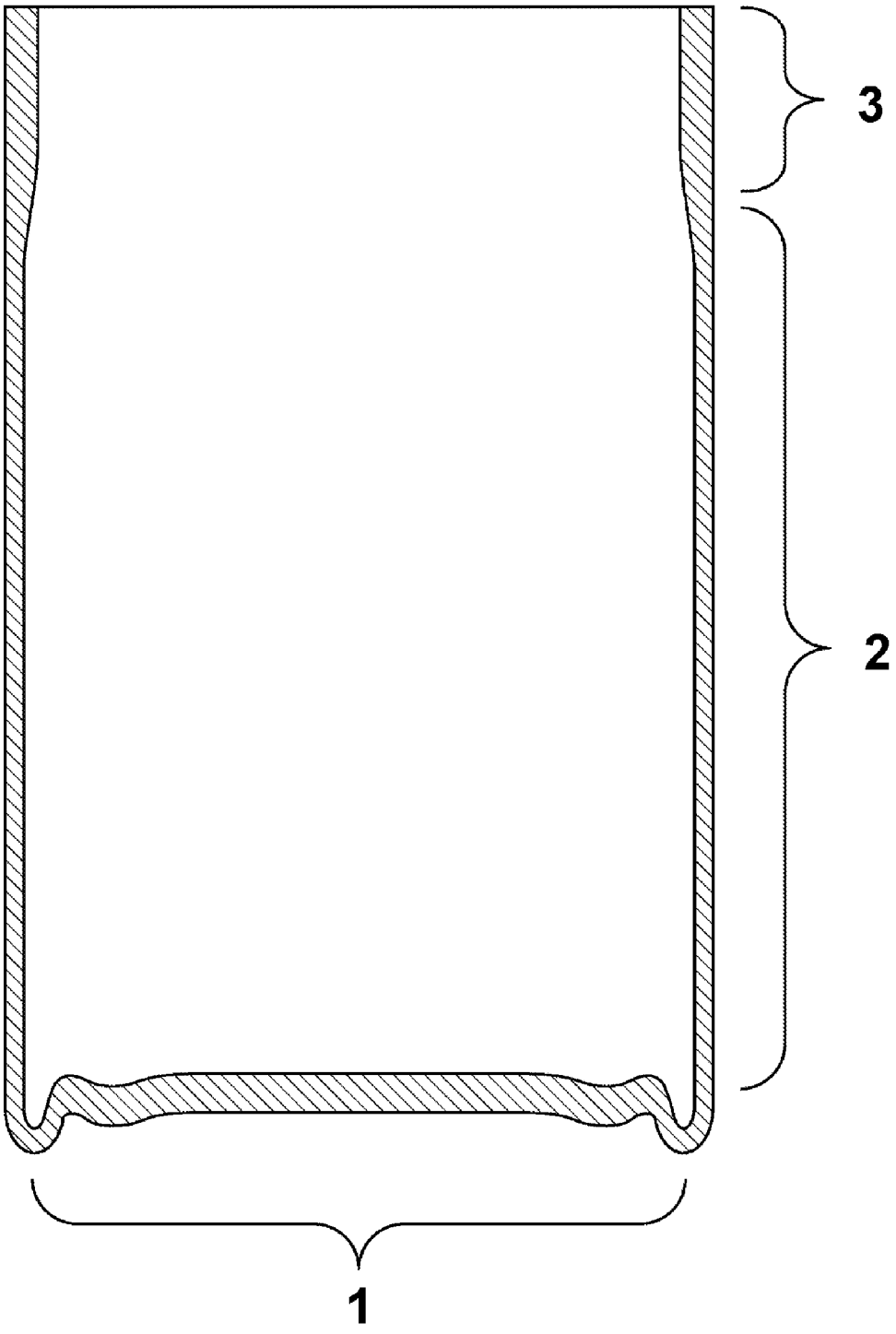
Figure 1 Prior Art
FIG. 1 is a side elevation view of a container body of the background art resulting from a conventional DWI process. It shows the distribution of material in the base and sidewall regions of the container body.
Figure 2:
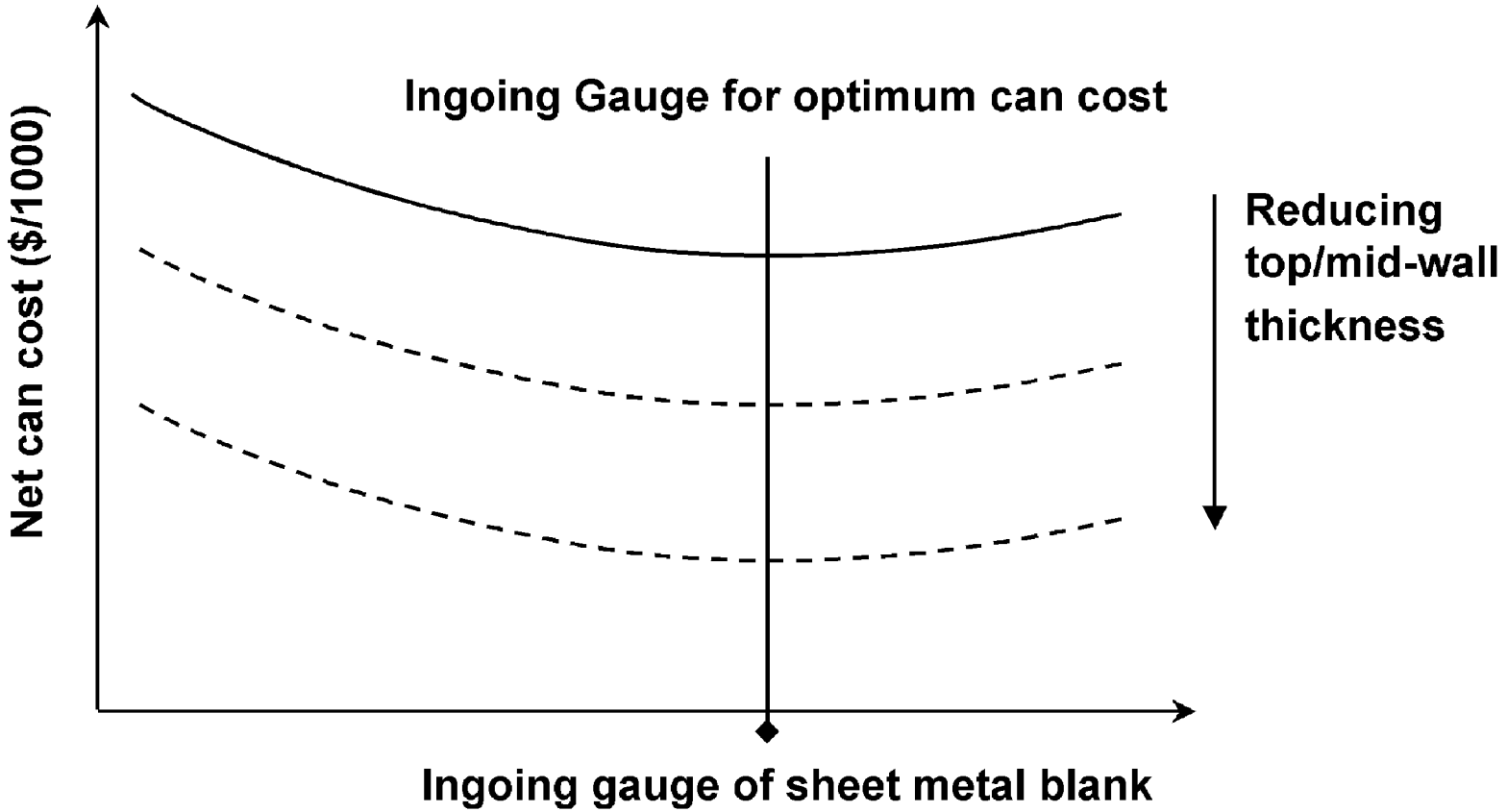
Figure 2 Prior Art
FIG. 2 is a graph showing in general terms how the net overall cost of manufacturing a typical two-piece metal container varies with the ingoing gauge of the sheet metal. The graph shows how reducing the thickness of the sidewall region (e.g. by ironing) has the effect of driving down the net overall cost.
Figure 3:
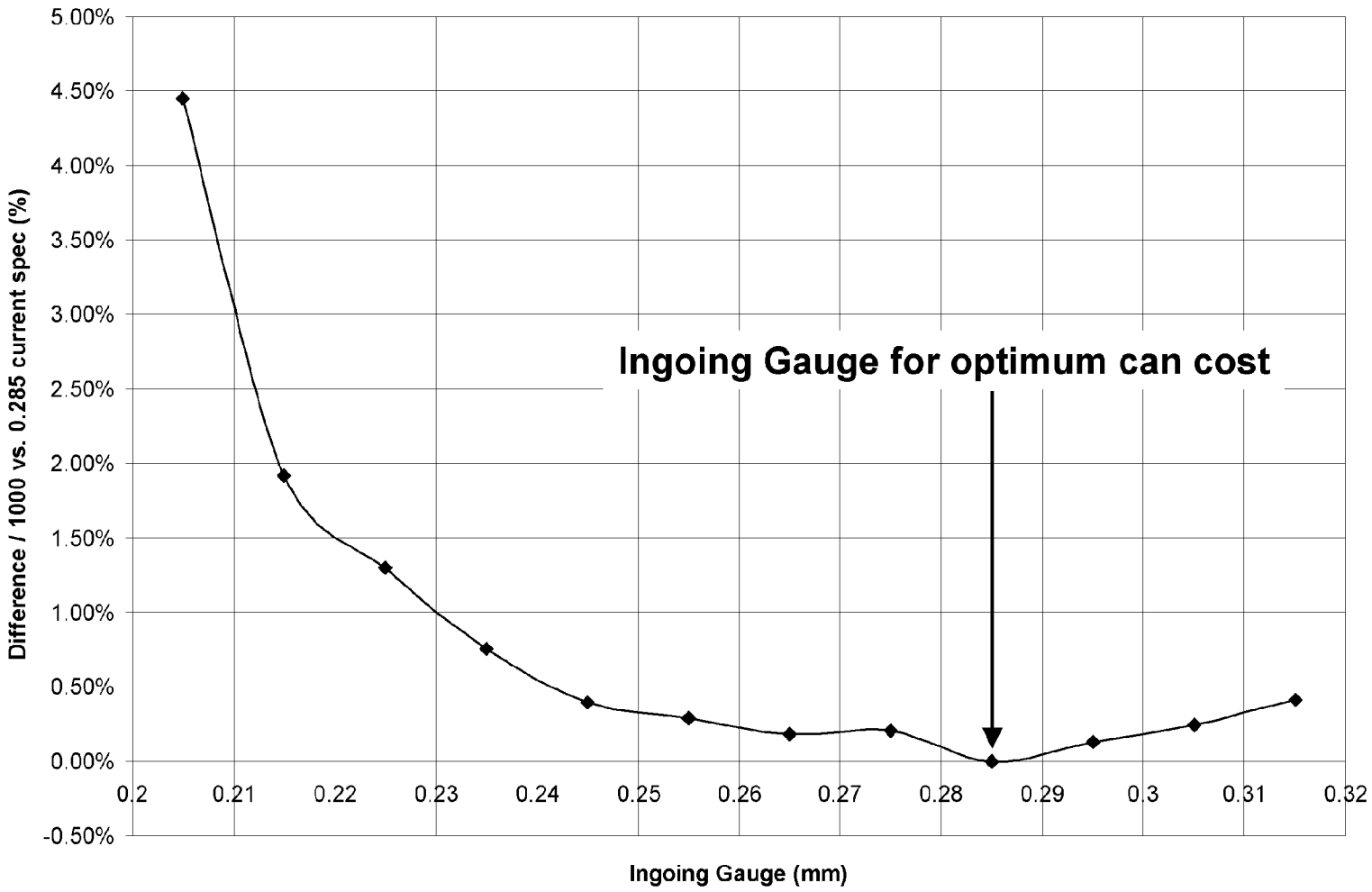
FIG. 3 is a graph corresponding to FIG. 2, but based on actual price data for UK-supplied tinplate.
Figure 4:
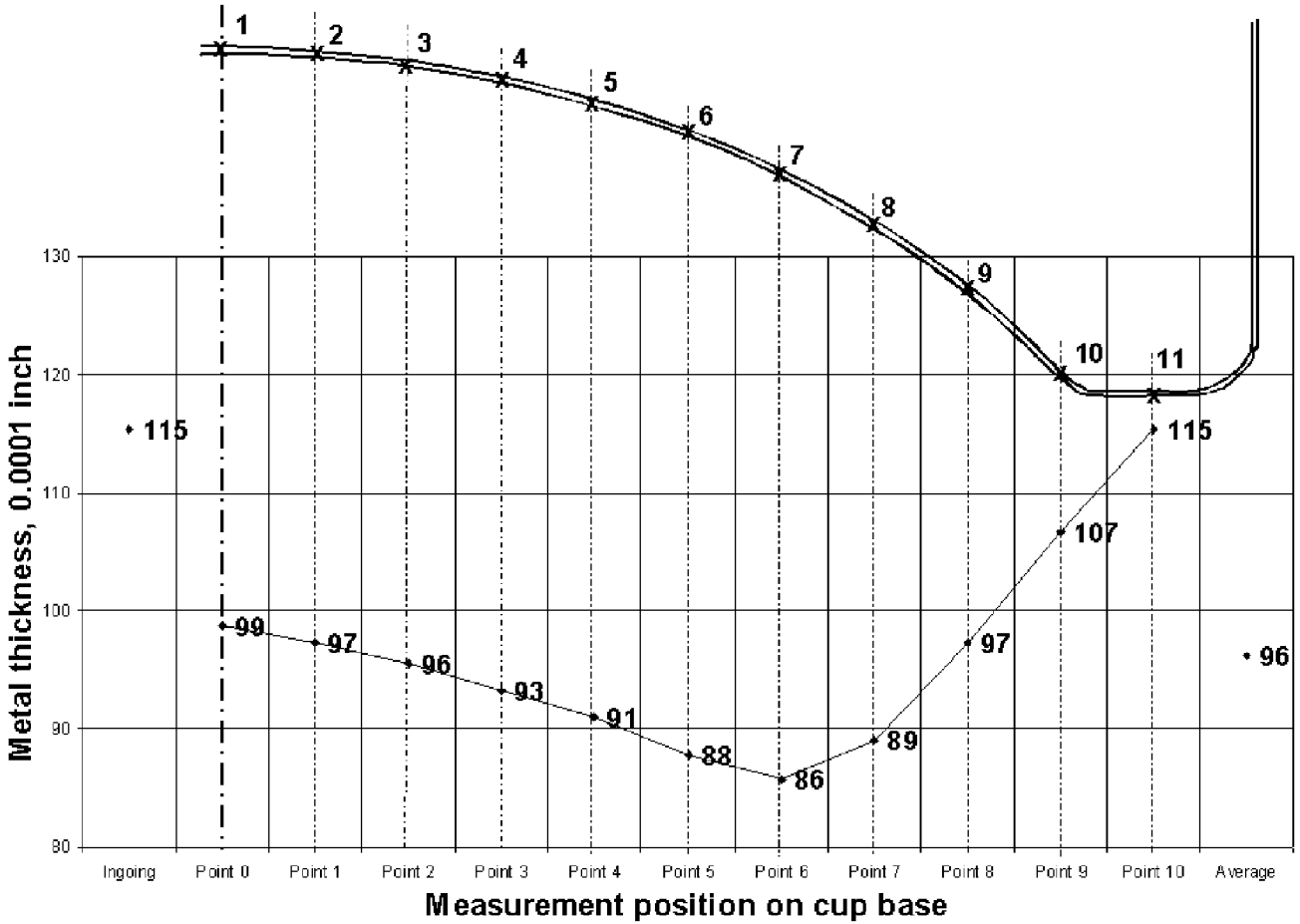
Figure 4 Prior Art

Embodiments of the invention are illustrated in the following drawings, with reference to the accompanying description:

FIG. 4 is a graphical representation of the variation in base thickness of a cup resulting from use of a "stretch" punch (according to the invention) having a domed profiled end face.

Figure 5A:
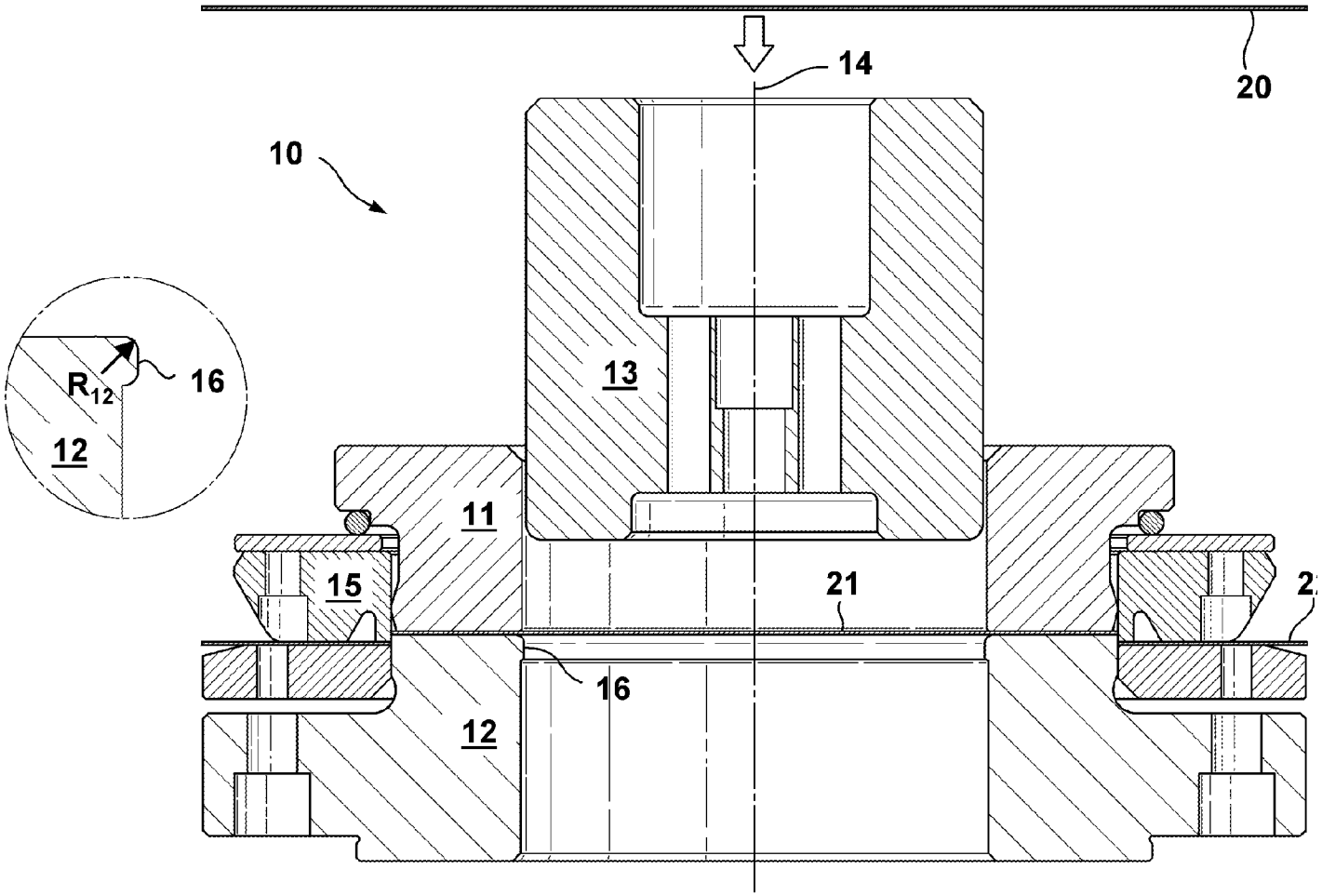

FIG. 5*a* is a side elevation view of the tooling of a cupping press used to form a first stage cup from a sheet metal blank. The figure shows the tooling before the initial drawing operation has commenced.

Figure 5B:
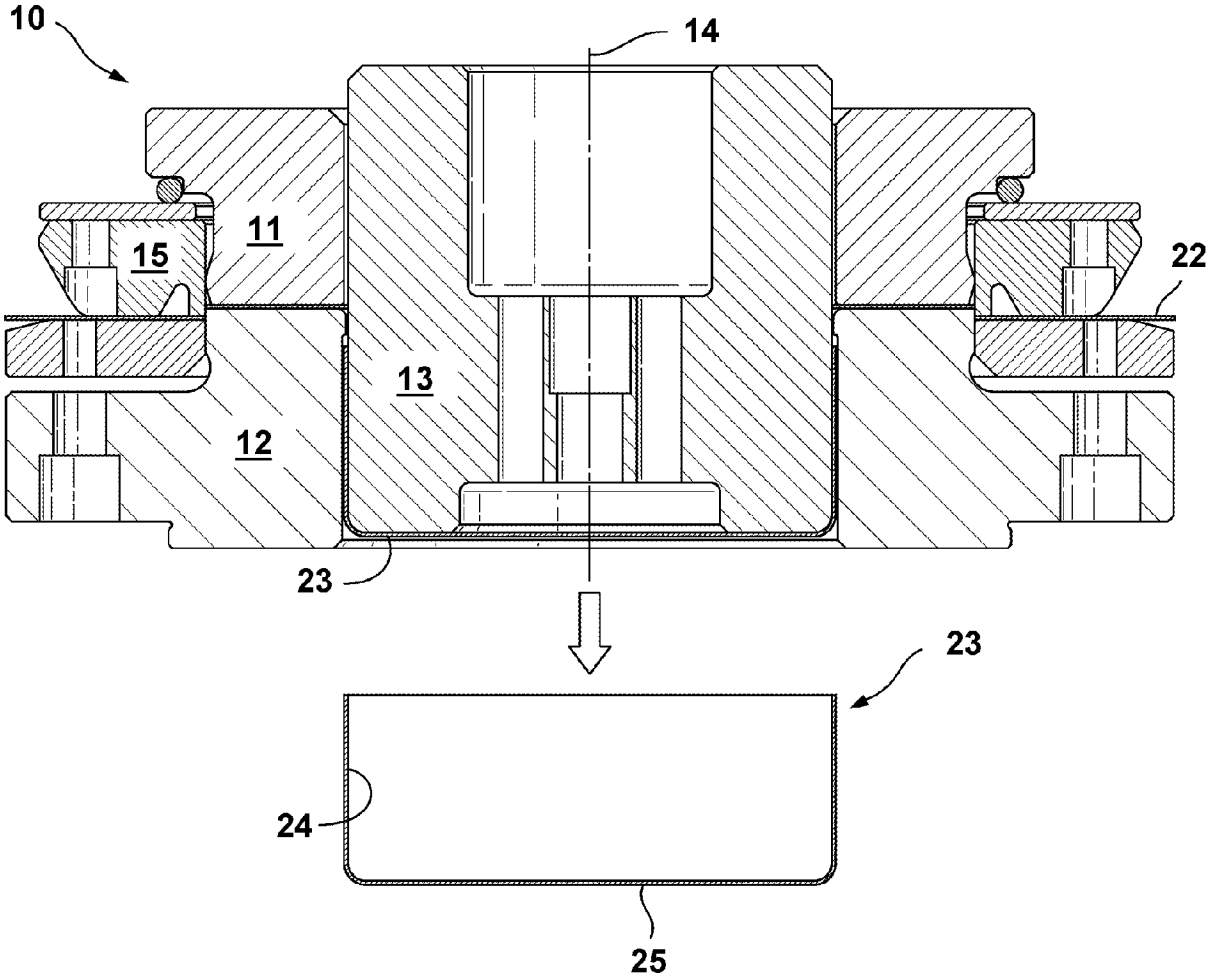

FIG. 5*b* corresponds to FIG. 5*a*, but on completion of the initial drawing operation to form the first stage cup.

Figure 6A:
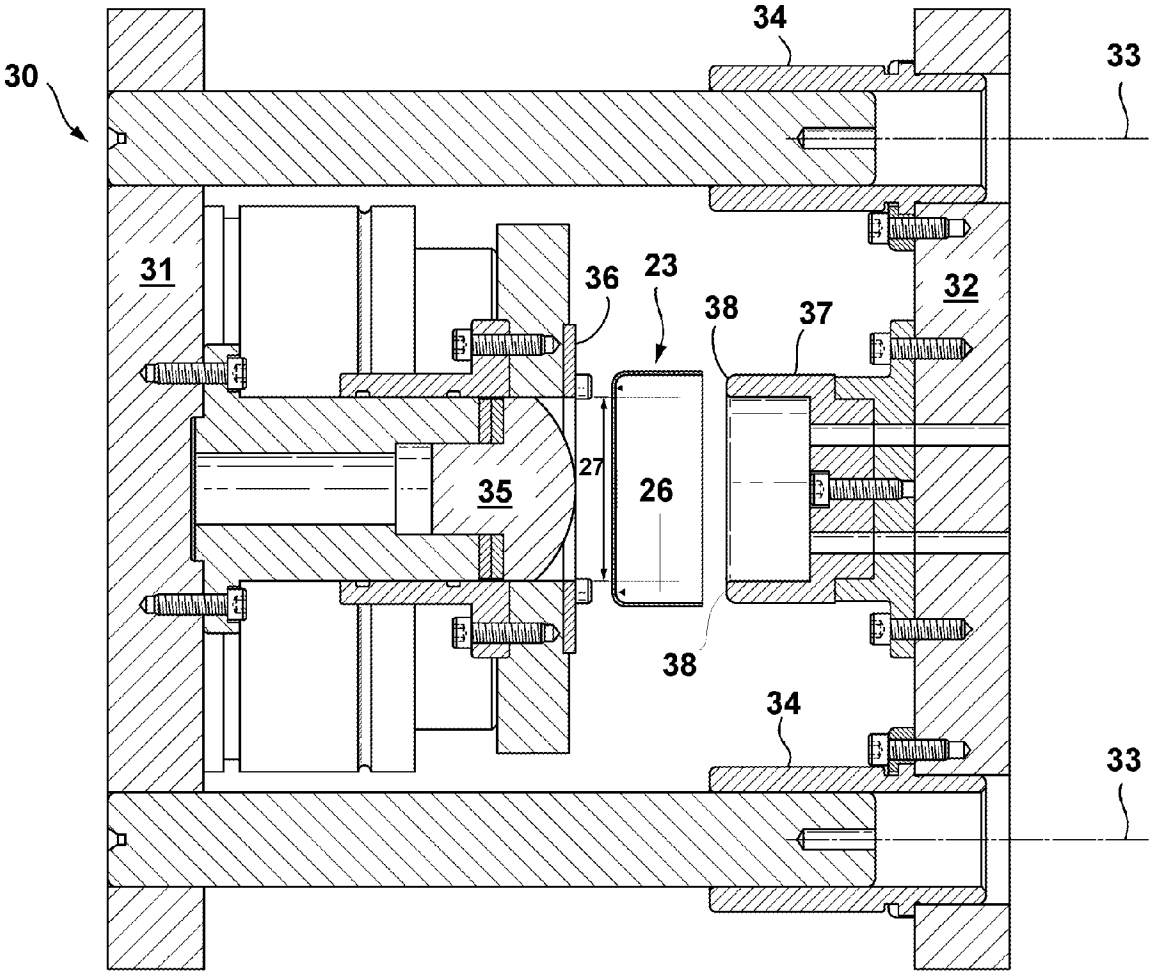

FIG. 6*a* is a side elevation view of a stretch rig used to perform the stretching operation of the invention. The figure shows the stretch rig before the stretching operation has commenced.

Figure 6B:
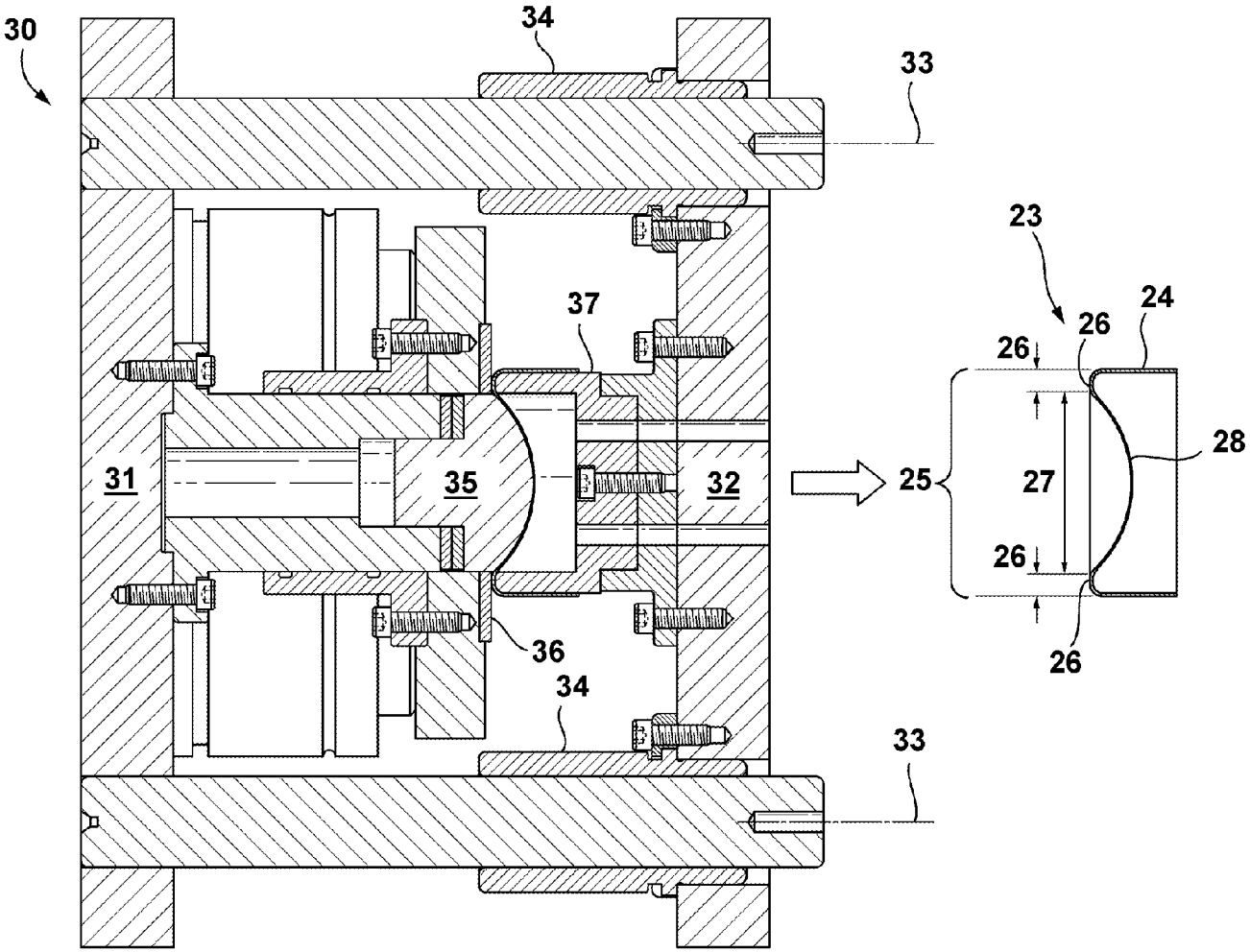

FIG. 6*b* shows the stretch rig of FIG. 6*a*, but on completion of the stretching operation.

Figure 7A:
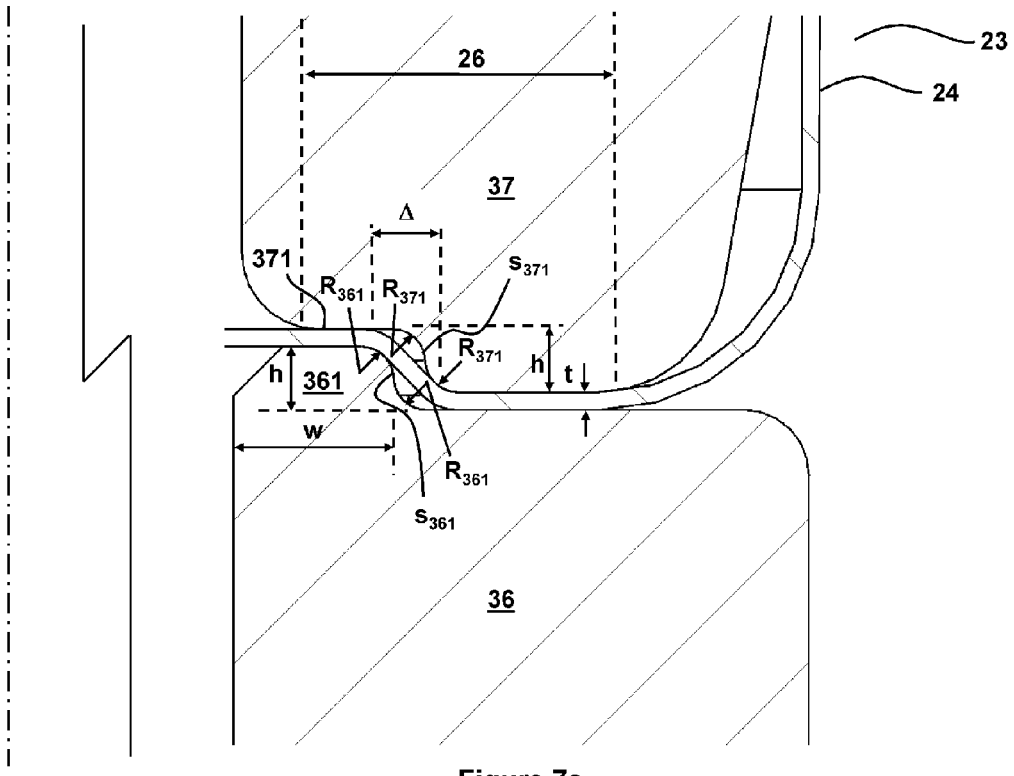

FIG. 7*a* shows a cross-section through a first embodiment of clamping means used to clamp the first stage cup during the stretching operation.

Figure 7B:
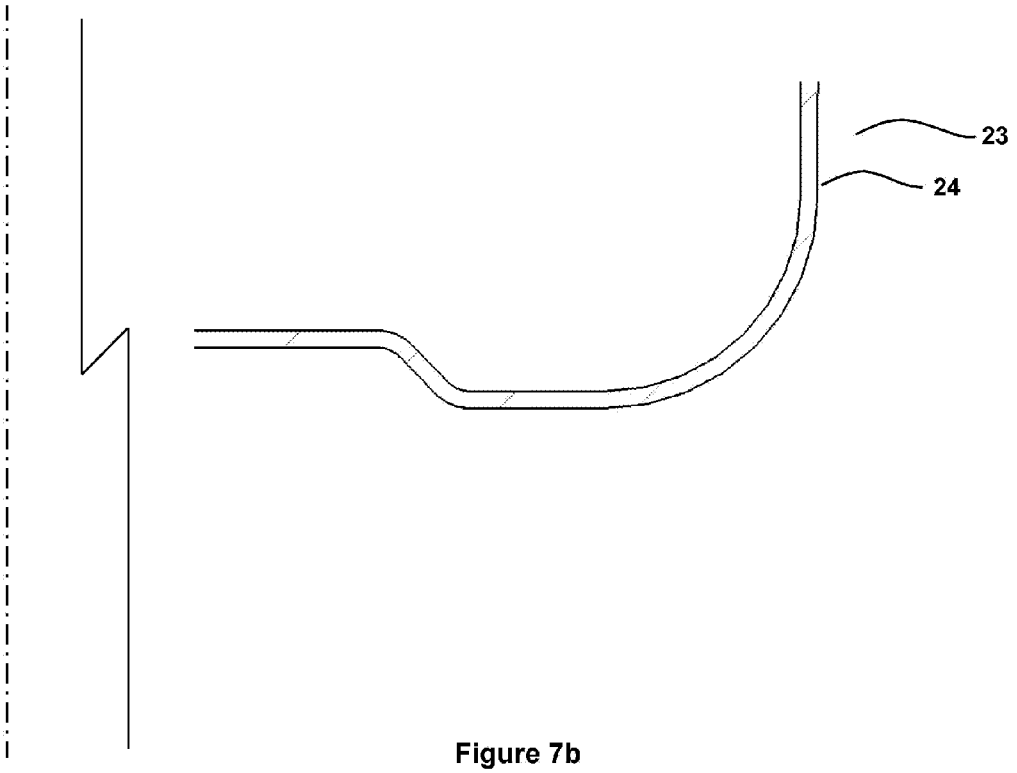

FIG. 7*b* shows a cross-section through part of the base of the cup resulting from use of the clamping means shown in FIG. 7*a*.

Figure 8A:
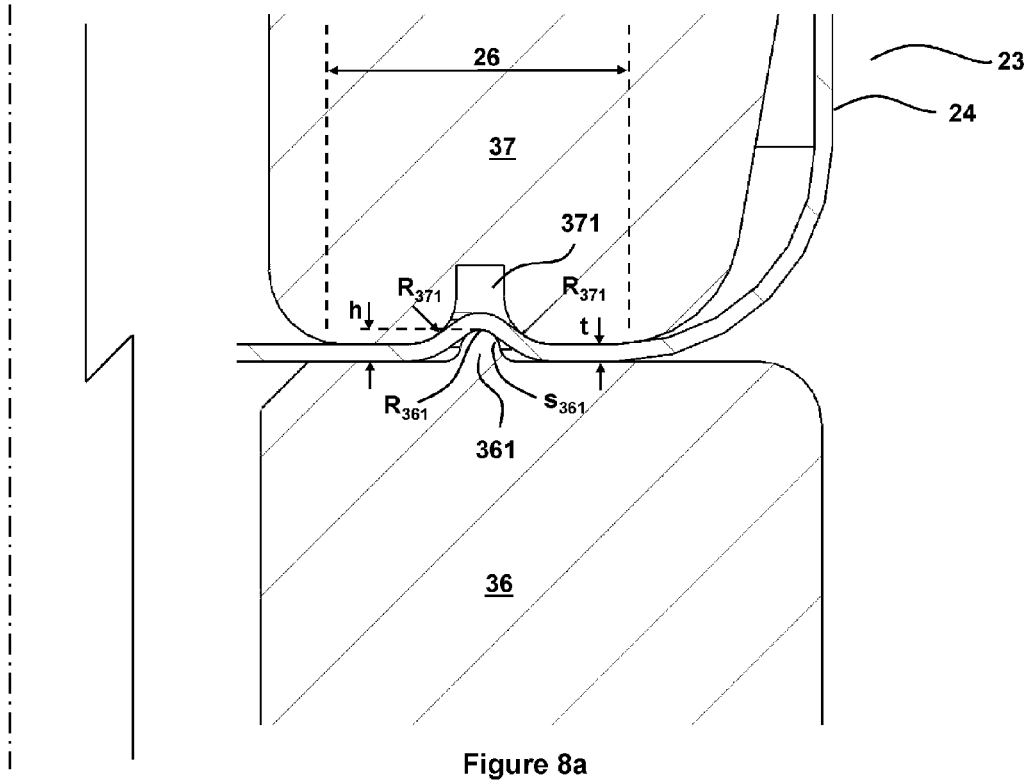

FIG. 8*a* shows a cross-section through a second embodiment of clamping means used to clamp the first stage cup during the stretching operation.

Figure 8B:
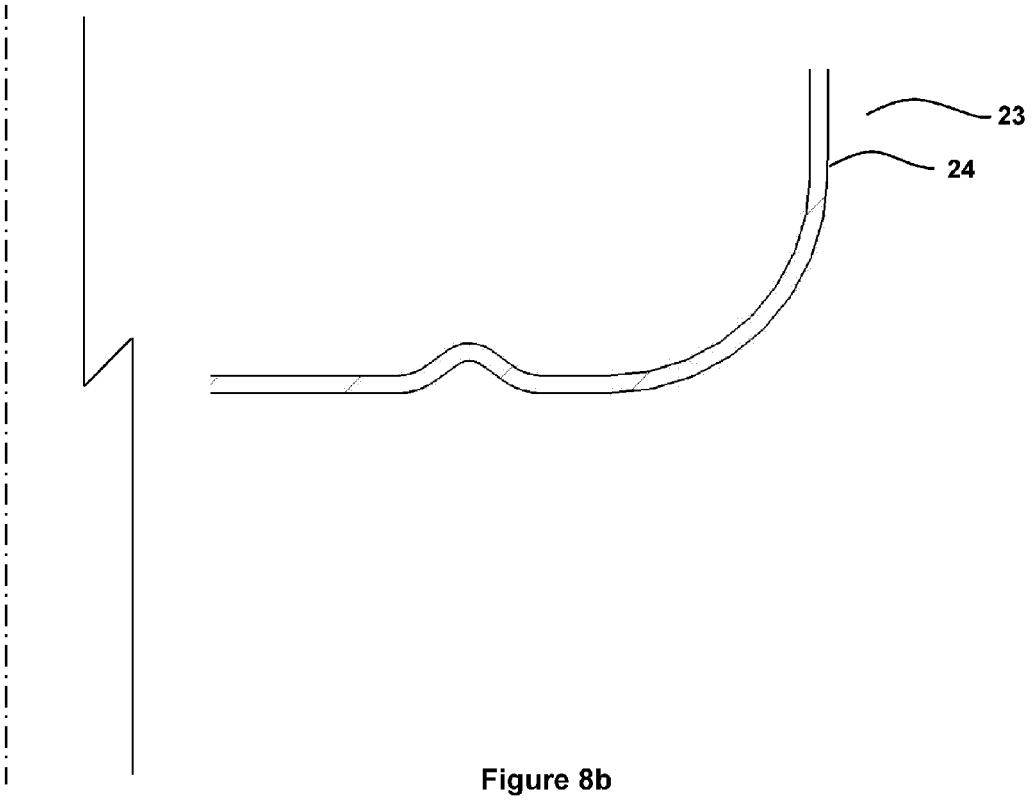

FIG. 8*b* shows a cross-section through part of the base of the cup resulting from use of the clamping means shown in FIG. 8*a*.

Figure 9:
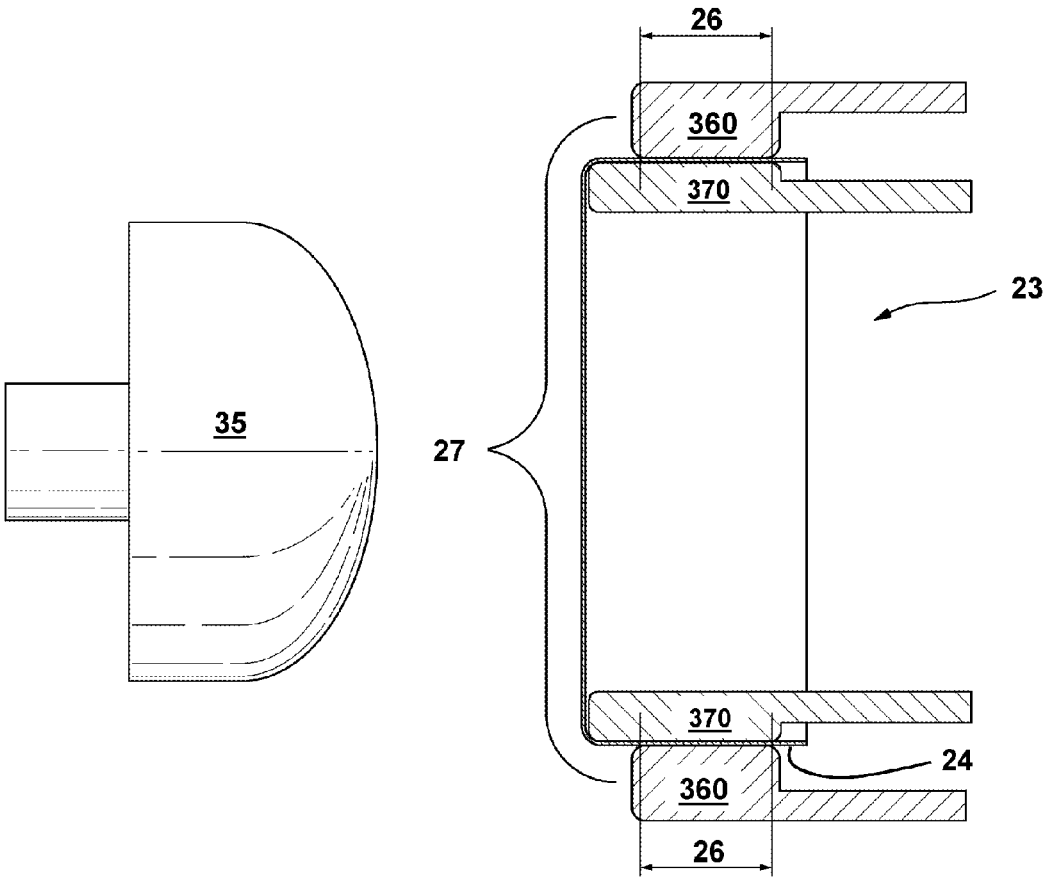

FIG. 9 shows an alternative embodiment to that of FIGS. 6*a* and 6*b*, in which the cup is clamped about its sidewall for the stretching operation.

Figure 10:
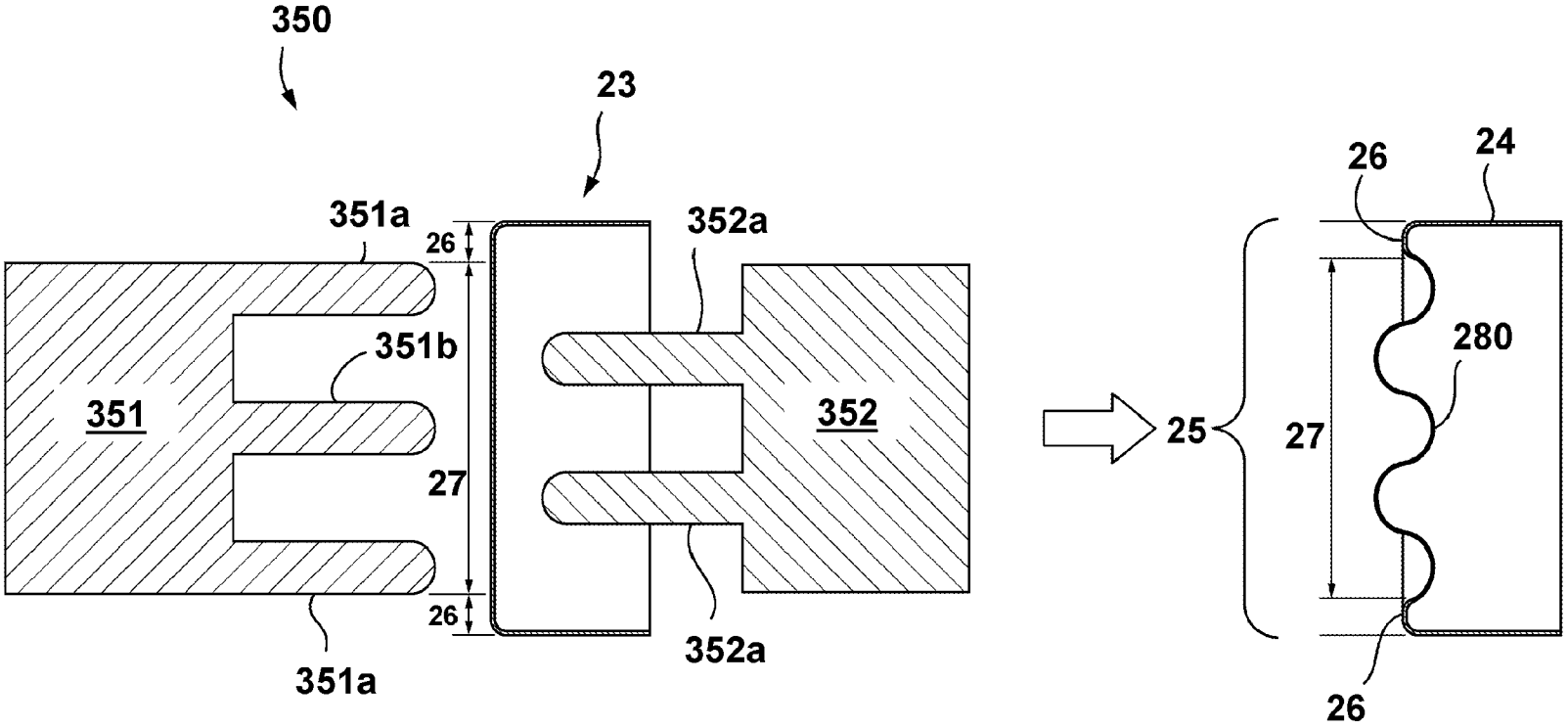

FIG. 10 shows an alternative embodiment of stretch punch to that shown in FIGS. 6*a* and 6*b*.

Figure 11:
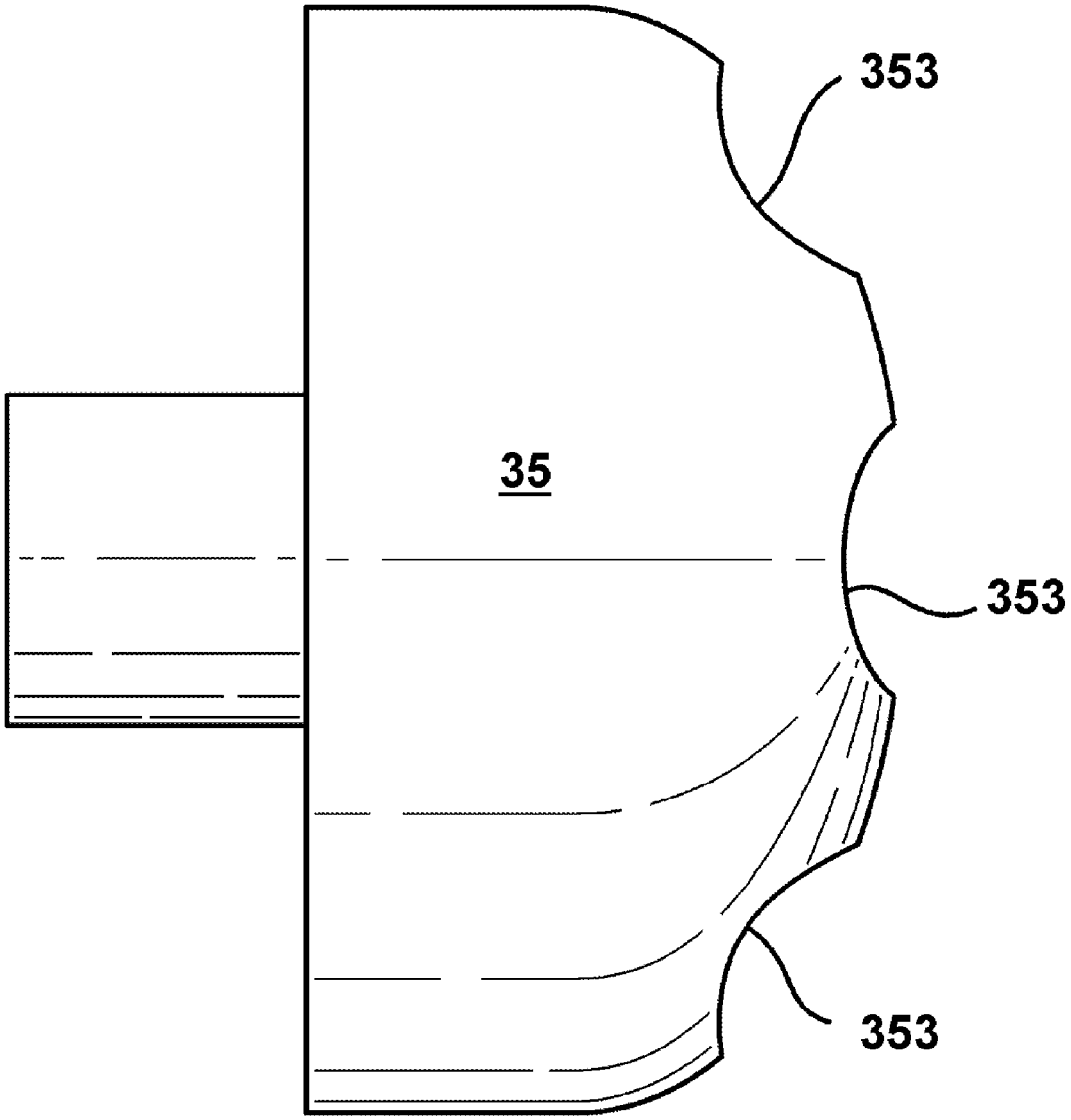

FIG. 11 shows a further alternative embodiment of stretch punch to those shown in FIGS. 6*a*, 6*b* and 10, where the end face of the stretch punch includes various relief features.

FIGS. 12*a-d* show perspective views of a bodymaker assembly used to re-draw the stretched cup. The figures show the operation of the bodymaker from start to finish of the (post-stretch) drawing operation.

Figure 12A:
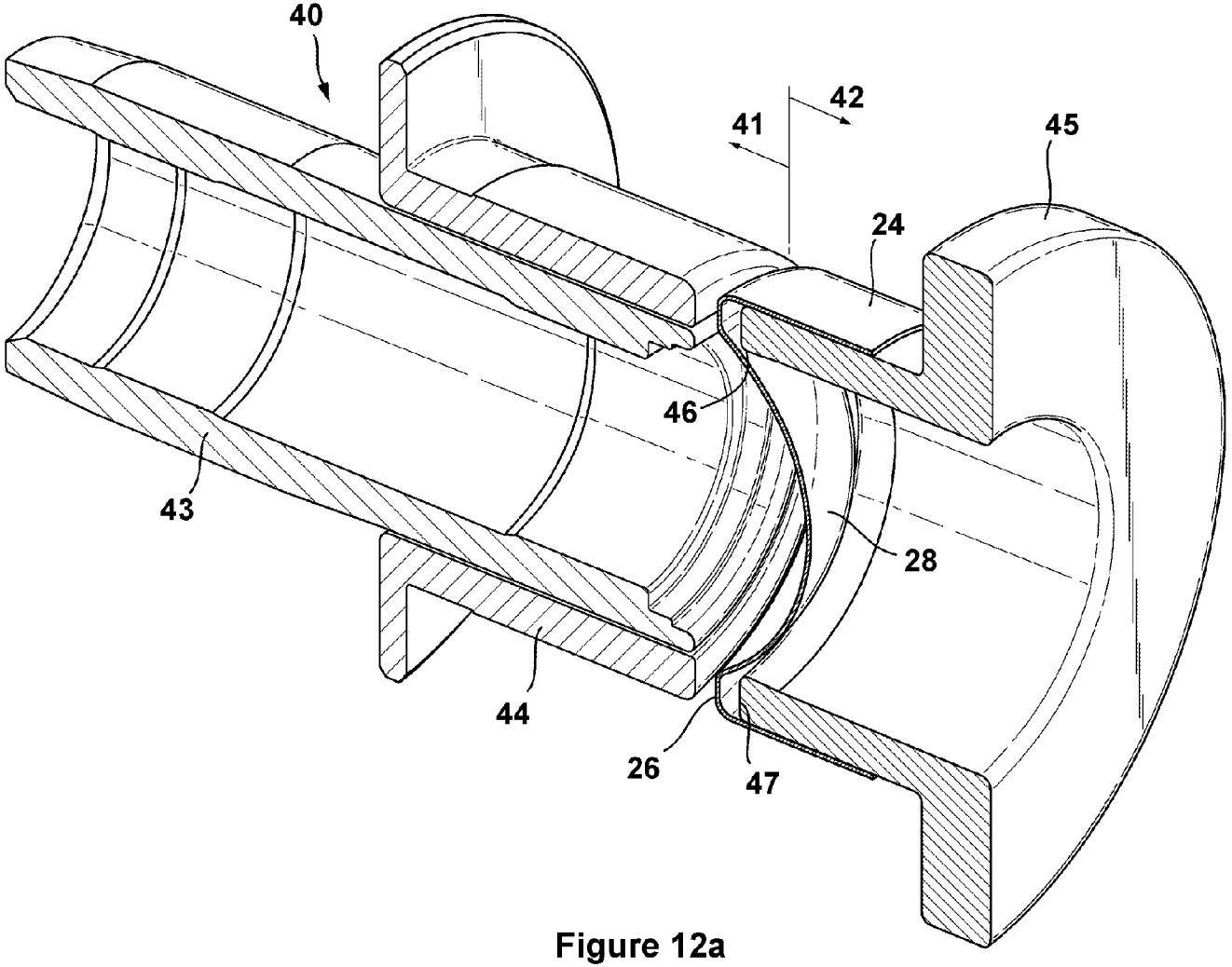
Figure 12B:
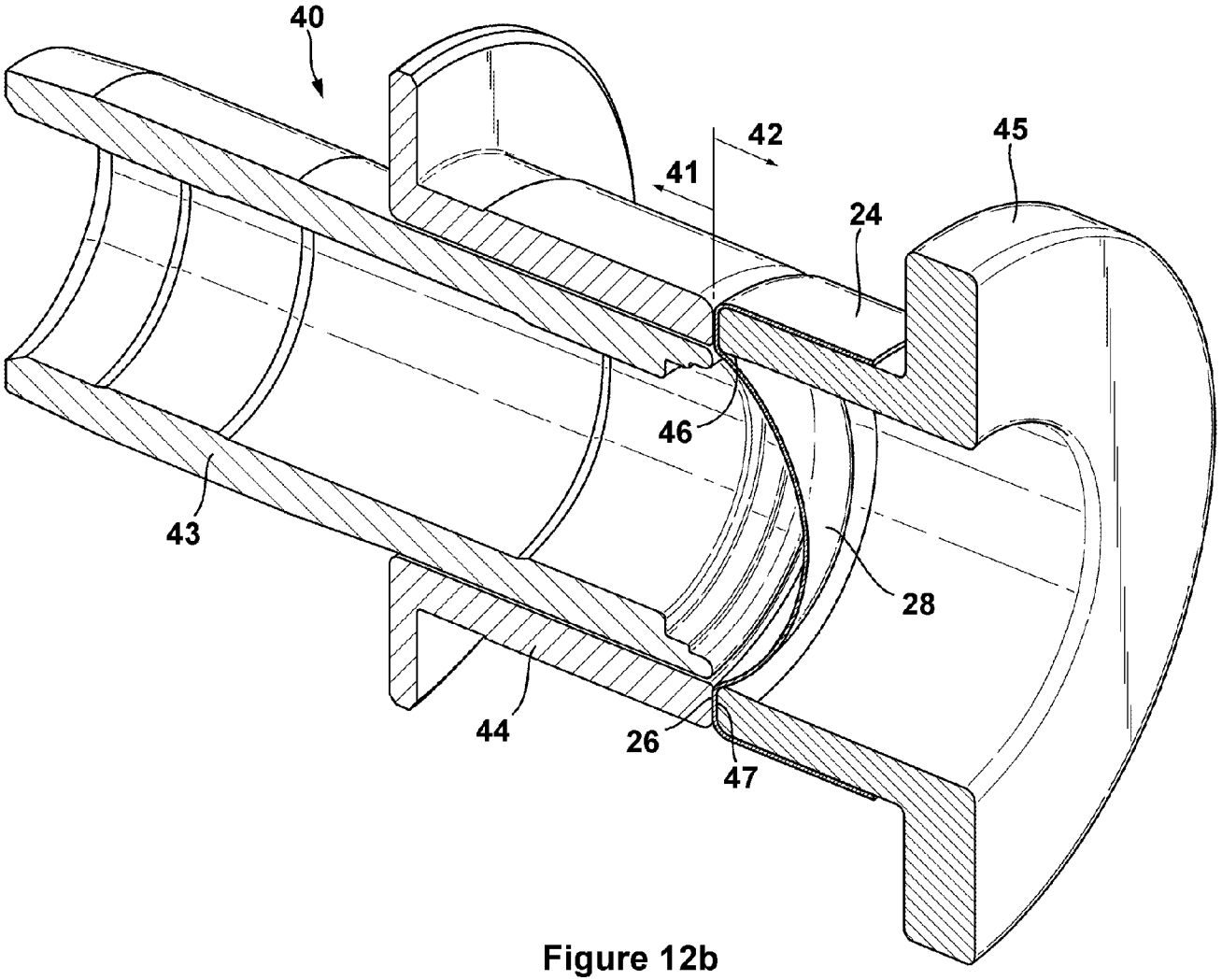
Figure 12C:
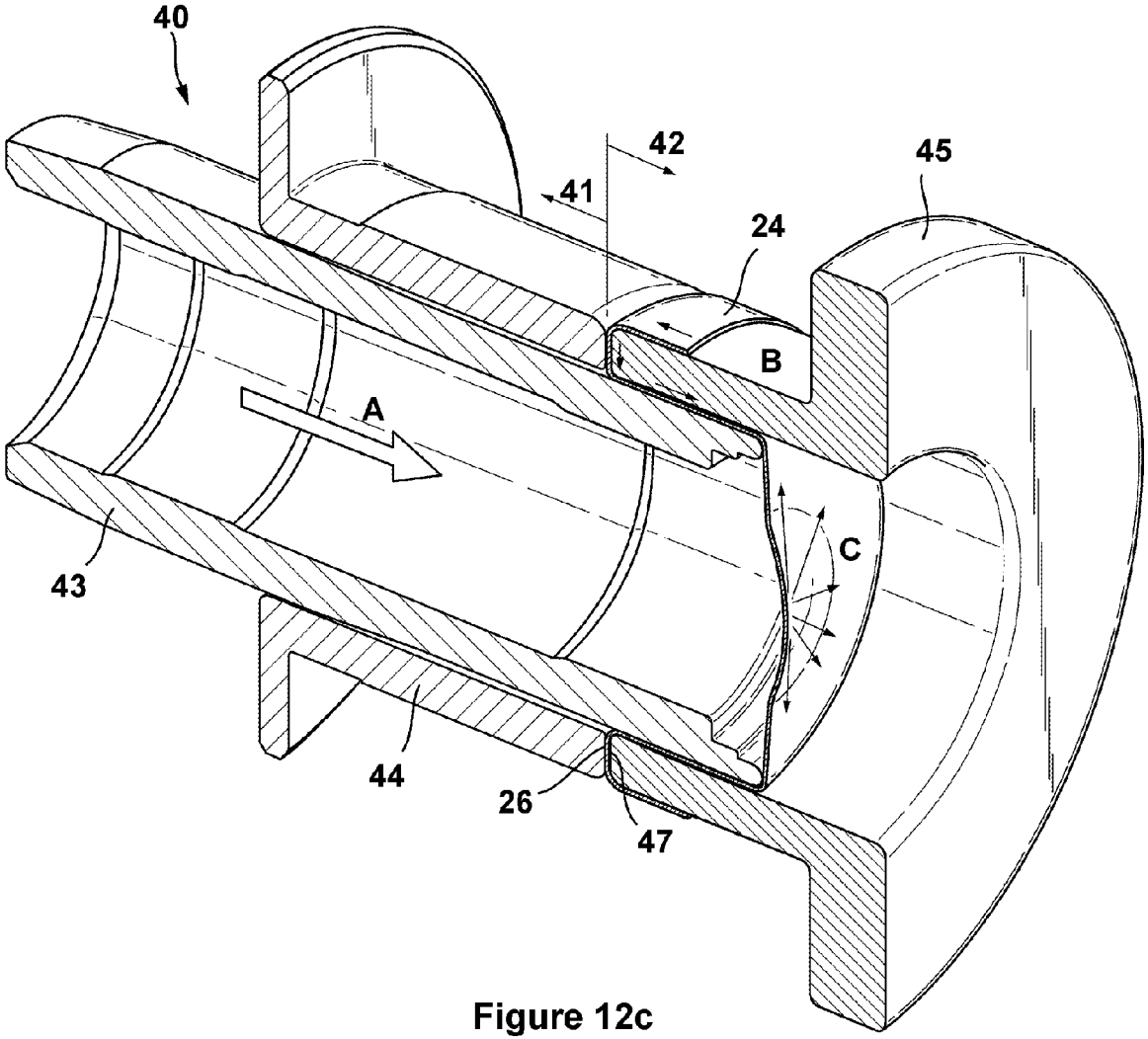
Figure 12D:
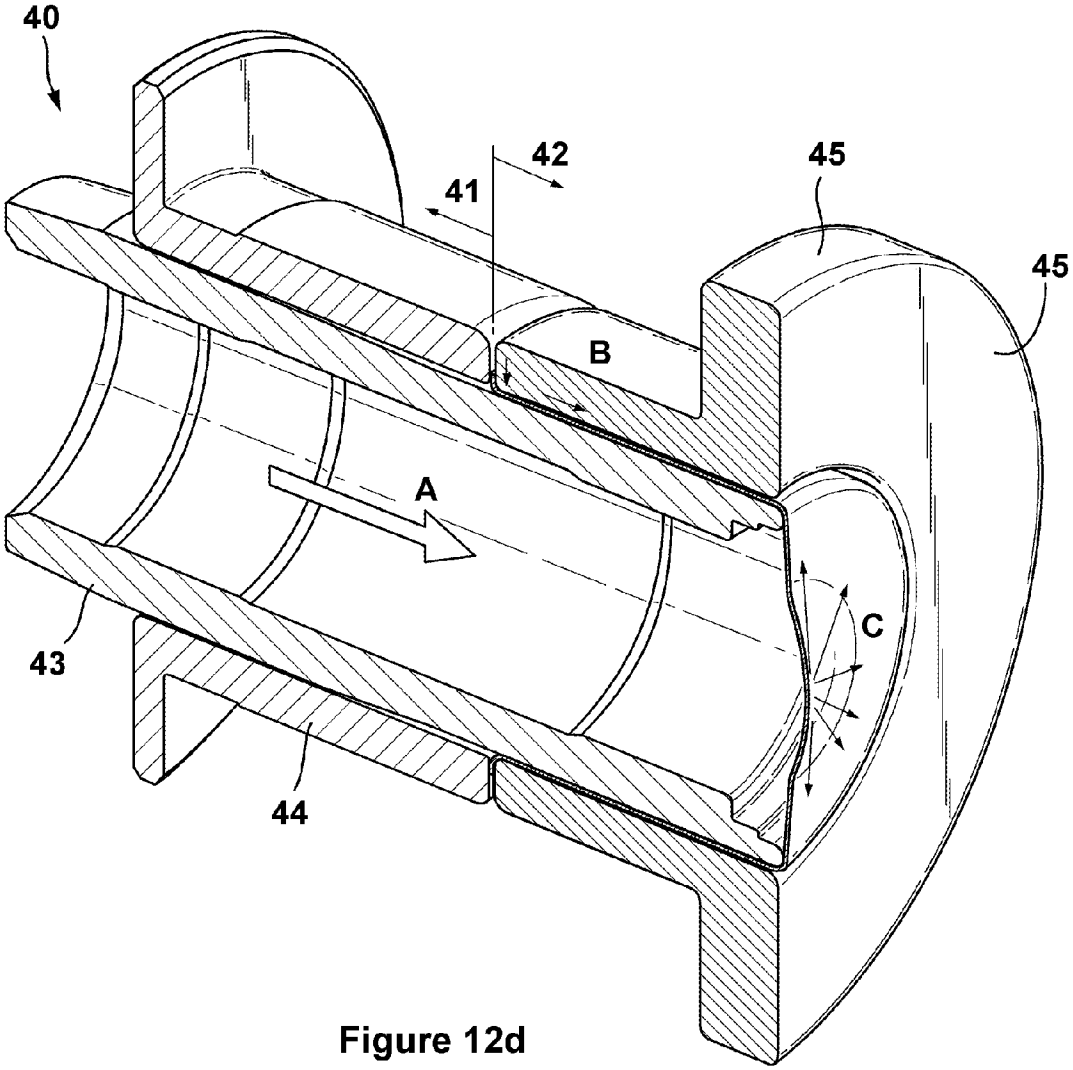
Figure 13:
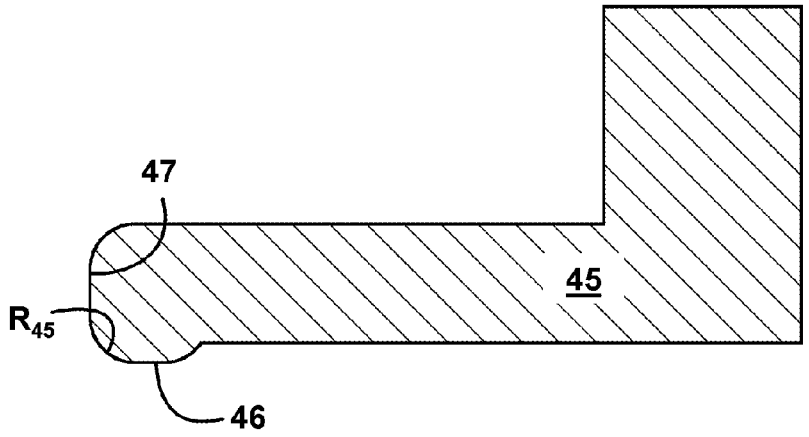

FIG. 13 shows a detail view of the re-draw die used in the bodymaker assembly of FIGS. 12*a-d*.

Figure 14:
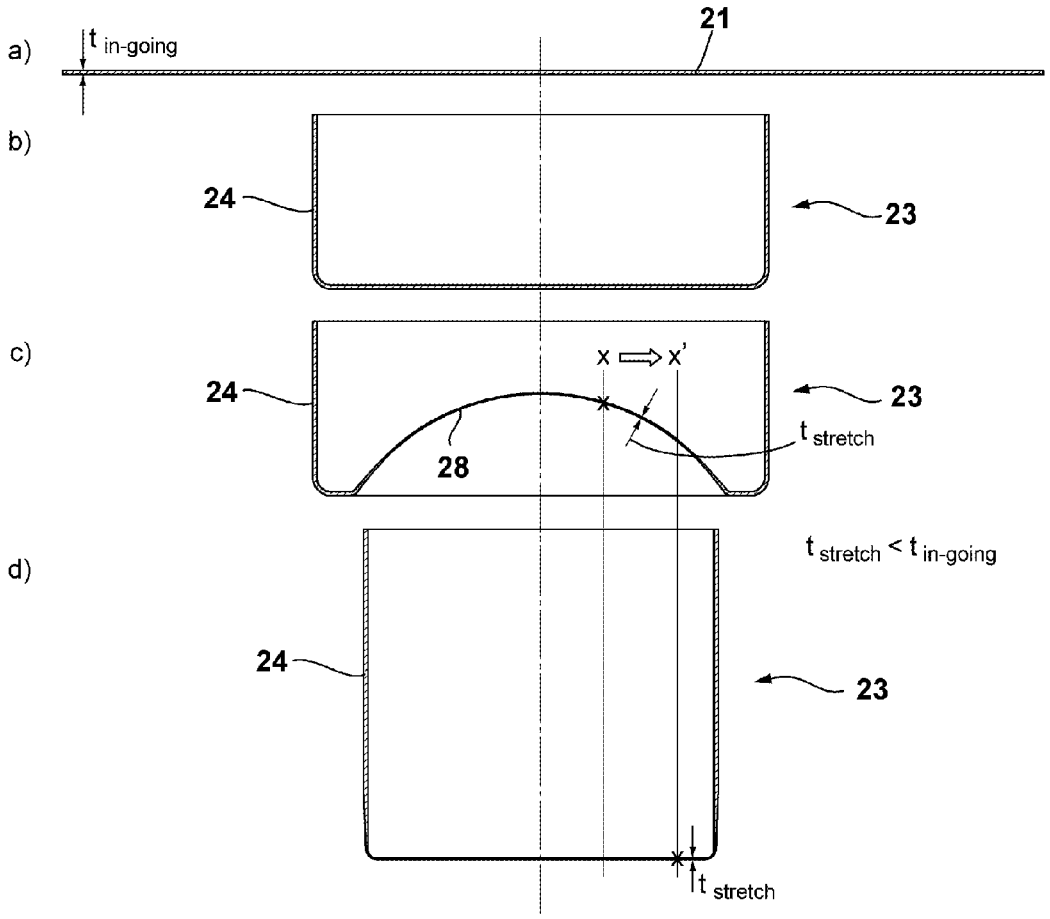

FIG. 14 shows the sheet metal blank at various stages during the method of the invention as it progresses from a planar sheet to a finished cup.

Figure 15:
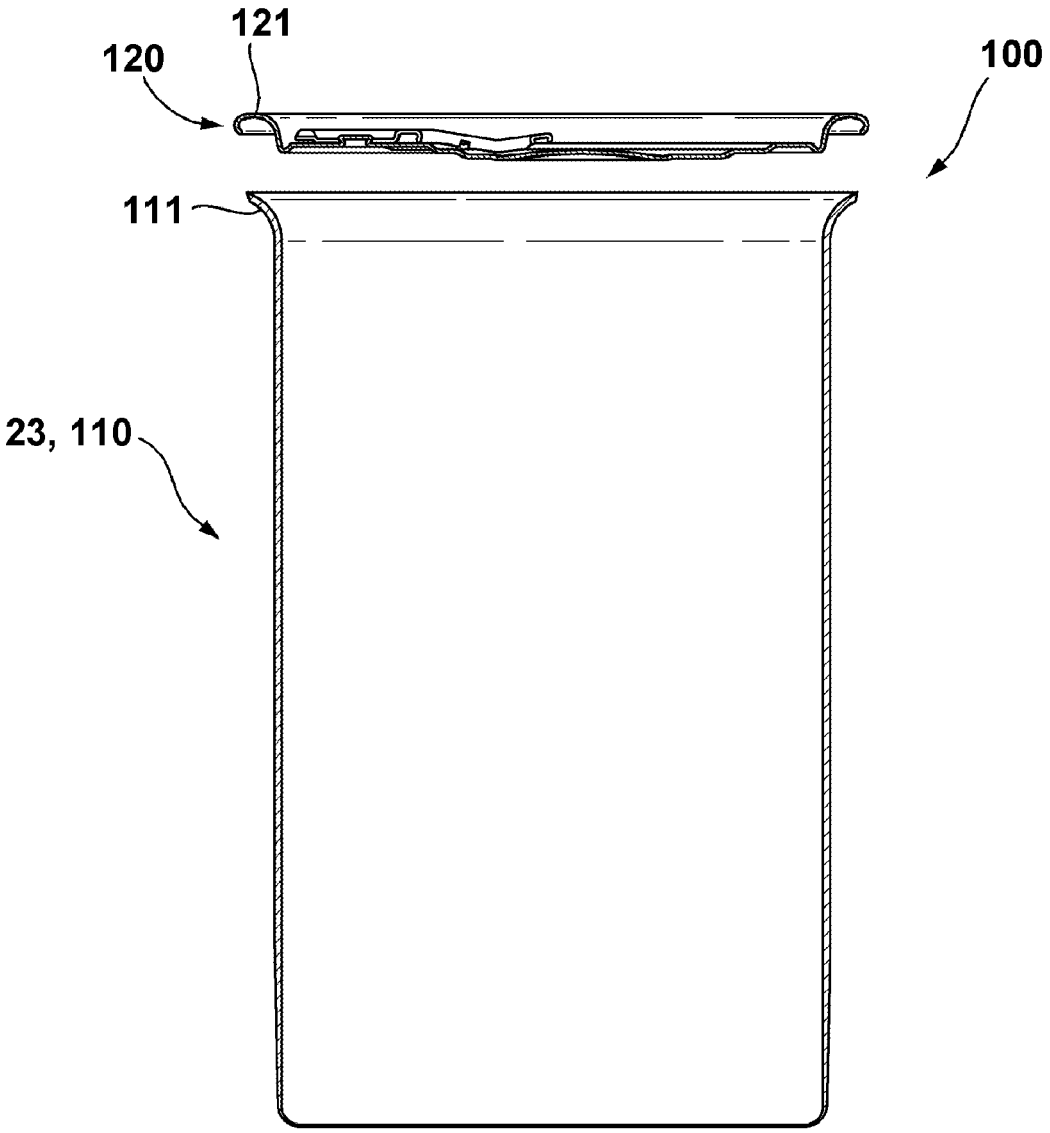

FIG. 15 shows the use of the cup of the invention as part of a two-piece container.

MODE(S) FOR CARRYING OUT THE INVENTION

Initial Drawing Operation

A cupping press 10 has a draw pad 11 and a draw die 12 (see FIGS. 5*a* and 5*b*). A draw punch 13 is co-axial with the draw die 12, as indicated by common axis 14. A circumferential cutting element 15 surrounds the draw pad 11.

In use, a flat section of metal sheet 20 is held in position between opposing surfaces of the draw pad 11 and the draw die 12. Steel tin-plate (Temper 4) with an ingoing gauge thickness ($t_{in\text{-}going}$) of 0.280 mm has been used for the metal sheet 20. However, the invention is not limited to particular gauges or metals. The section of metal sheet 20 is typically cut from a roll of metal sheet (not shown). After the section of metal sheet 20 has been positioned, the circumferential cutting element 15 is moved downwards to cut a circular planar blank 21 out from the metal sheet (see FIG. 5*a*). The excess material is indicated by 22 on FIG. 5*a*.

After the blank 21 has been cut from the sheet 20, the draw punch 13 is moved axially downwards through the draw die 12 to progressively draw the planar blank against the forming surface 16 of the draw die 12 into the profile of a cup 23 having a sidewall 24 and integral base 25. This initial drawing operation is shown in FIG. 5*b*, and includes a separate view of the drawn cup 23 when removed from the press 10. A detail view is included in FIG. 5*a* of the radius $R_{12}$ at the junction between the end face of the draw die 12 and its forming surface 16. As for conventional drawing operations, the radius $R_{12}$ and the load applied by the draw pad 11 to the periphery of the blank 21 are selected to permit the blank to slide radially inwards between the opposing surfaces of the draw pad 11 and draw die 12 and along forming surface 16 as the draw punch 13 moves progressively downwards to draw the blank into the cup 23. This ensures that the blank 21 is predominantly drawn, rather than stretched (thinned) (or worse, torn about the junction between the end face of the draw die and the forming surface 16 of the draw die). Dependent on the size of radius $R_{12}$ and, to a lesser extent, the severity of the clamping load applied by the draw pad 11, the wall thickness of the cup 23 will be essentially unchanged from that of the ingoing gauge of the blank 21, i.e. negligible stretching or thinning should occur. However, in alternative embodiments of the invention, it is permissible for the load applied by the draw pad 11 to be sufficient that a combination of drawing and stretching occurs under the action of the draw punch 13. The cup 23 that results from this initial drawing operation is also referred to the "first stage cup".

Stretching Operation

Following the initial drawing operation shown in FIGS. 5*a* and 5*b*, the drawn cup 23 is transferred to a stretch rig 30, an example of which is illustrated in FIGS. 6*a* and 6*b*. The stretch rig 30 has two platens 31, 32 that are moveable relative to each other along parallel axes 33 under the action of loads applied through cylinders 34 (see FIGS. 6*a* and 6*b*). The loads may be applied by any conventional means, e.g. pneumatically, hydraulically or through high-pressure nitrogen cylinders.

On platen 31 is mounted a stretch punch 35 and a clamping element in the form of an annular clamp ring 36. The annular clamp ring 36 is located radially outward of the stretch punch 35. The stretch punch 35 is provided with a domed end face (see FIGS. 6*a* and 6*b*).

On platen 32 is mounted a cup holder 37. The cup holder 37 is a tubular insert having an annular end face 38 and an outer diameter corresponding to the internal diameter of the drawn cup 23 (see FIGS. 6*a* and 6*b*). In use, the drawn cup 23 is mounted on the cup holder 37 so that the annular end face 38 contacts a corresponding annular region 26 on the cup's base 25 (see FIGS. 6*a* and 6*b*). Loads are applied via the cylinders 34 to move platens 31, 32 towards each other along the axes 33 until the annular region 26 is clamped firmly in an annular manner between the planar surface of the clamp ring 36 and the annular end face 38 of the cup holder 37. In this way, the clamp ring 36 and cup holder 37 each act as clamping elements, with the annular region 26 clamped in an annular manner between the planar surface of the clamp ring 36 and the annular end face 38 of the cup holder 37. The clamped annular region 26 defines an enclosed portion 27 of the cup. In the embodiment shown in FIGS. 6*a* and 6*b*, the annular clamping thereby separates the base 25 into two discrete regions: the clamped annular region 26 and the enclosed portion 27.

The stretch punch 35 is then moved axially through the clamp ring 36 to progressively deform and stretch (thin) the metal of the enclosed portion 27 into a domed profile 28 (see FIG. 6*b*).

In the embodiment shown in the drawings, the enclosed portion 27 is domed inwardly 28 into the cup (see FIG. 6*b*). This inward doming helps to minimise the volume envelope occupied by the cup and thereby assists subsequent handling operations of the cup. However, in an alternative embodiment, the enclosed portion 27 may instead be domed outwardly outside of the cup.

Ideally, the clamping loads applied during this stretching operation are sufficient to ensure that little or no material from the clamped annular region 26 (or from outside of the clamped region, such as from the sidewall 24) flows into the enclosed portion 27 during stretching. This helps to maximise the amount of stretching and thinning that occurs in the domed region 28. However, as indicated above in the general description of the invention, it has been found that stretching and thinning of the enclosed portion 27 can still occur when permitting a limited amount of flow of material from the clamped annular region 26 (or from outside of the clamped region) into the enclosed portion.

In summary, this stretching operation and the resulting thinning of the base 25 is critical to achieving manufacture of a cup or container body having a base thickness which is less than that of the ingoing gauge of the metal sheet.

FIGS. 7*a* & 8*a* show detail views of two embodiments of the clamp ring 36 and cup holder 37 used to clamp the first stage cup during the stretching operation.

FIG. 7*a* shows the face of the clamp ring 36 provided with an annular step 361 having a width w that opens out to the radial interior edge of the clamp ring. A corresponding annular cut-out 371 is provided in the face of the cup holder 37. In the embodiment shown, the step 361 and cut-out 371 have a height h of 1 mm and radii $R_{361,\ 371}$ of 0.5 mm. The axially extending sides $s_{361,371}$ of the step 361 and cut-out 371 are radially offset from each other by a distance greater than the thickness t of the metal sheet they are intended to clamp (see distance Δ in FIG. 7*a*). This avoids the metal sheet being pinched or coined during clamping and thereby helps to minimise the formation of a weakened region that would be vulnerable to tearing during the subsequent drawing operation (or any subsequent ironing operation).

FIG. 7*b* shows a partial view of the base of the corresponding cup that results from use of the clamping arrangement shown in FIG. 7*a*.

FIG. 8*a* shows the face of the clamp ring 36 provided with an annular bead 361 located away from the radial interior and exterior edges of the clamp ring. A corresponding annular recess 371 is provided in the face of the cup holder 37. In this alternative embodiment, the bead 361 is capable of being wholly enclosed by and within the recess 371—in contrast to the embodiment in FIG. 7*a*. Expressed another way, in use, the bead 361 of FIG. 8*a* urges metal of the clamped annular region 26 so as to be wholly enclosed by and within the recess 371. In this embodiment, the bead 361 has a height h of around 0.5 mm, with radii $R_{361,\ 371}$ of around 0.3 mm and 0.75 mm respectively. As can be seen from FIG. 8*a*, in common with the embodiment in FIG. 7*a*, the bead 361 and recess 371 are profiled to avoid the metal sheet being pinched or coined during clamping.

FIG. 8*b* shows a partial view of the base of the corresponding cup that results from use of the clamping arrangement shown in FIG. 8*a*.

Both clamping embodiments have been used on 0.277 mm and 0.310 mm gauge metal sheet. However, this statement is not intended to limit the scope or applicability of the method or apparatus of the invention.

Table 1 below shows for both clamping embodiments (FIGS. 7*a* and 8*a*) the axial clamping loads required during the stretching operation to achieve a given amount of stretching of the drawn cup 23. They clearly show that having the bead 361 adapted to be wholly enclosed by and within the recess 371 (as in the embodiment of FIG. 8*a*) drastically reduces the clamping loads required by almost 50% relative to the loads required when using the clamping arrangement of FIG. 7*a*. The reason for this difference in required axial clamping loads is that having the bead 361 capable of extending wholly within the corresponding recess 371 provides greater disruption to metal flow during the stretching operation and thereby provides an improved clamping effect. The disruption to metal flow is greater for the embodiment of FIG. 8*a* because the metal flow is disrupted by both axially extending sides $s_{361}$ of the bead 361, whereas for the embodiment of FIG. 7*a* the metal flow is only disrupted by a single axially extending side $s_{361}$ of its bead.

TABLE 1

| Clamping Embodiment | Axial Clamping Force (kN) | Slippage (mm) |
|---|---|---|
| FIG. 7a | 46-53 | 0.85-1.3 |
| FIG. 8a | 25-29 | 0.05 |

In an alternative embodiment shown in FIG. 9, the sidewall 24 rather than the base 25 is clamped during the stretching operation. FIG. 9 shows an annular region 26 of the sidewall adjacent the base being clamped between cup holder 370 and clamping element 360. Either or both of the cup holder 370 and clamping element 360 may be segmented to facilitate the clamping of the sidewall, and to accommodate cups of different sizes. The annular clamping of the sidewall 24 defines an enclosed portion 27 inward of the clamped annular region 26 (see FIG. 9). A stretch punch 35 is also indicated in FIG. 9. Note that other features of the stretch rig are excluded from FIG. 9 for ease of understanding.

In a further alternative embodiment, the single stretch punch 35 is replaced by a punch assembly 350 (as shown in FIG. 10). The punch assembly 350 has:

i) a first group 351 of an annular punch element 351*a* surrounding a central core punch element 351*b*; and ii) a second group 352 of an annular punch element 352*a*.

For ease of understanding, FIG. 10 only shows the punch assembly 350 and the drawn cup 23. Although not shown on FIG. 10, in use an annular region 26 of the cup's base 25 would be clamped during the stretching operation in a similar manner to the embodiment shown in FIGS. 6*a* and 6*b*.

In use, the first and second groups of punch elements 351, 352 face opposing surfaces of the enclosed portion 27. The stretching operation is performed by moving both first and second groups of punch elements 351, 352 towards each other to deform and stretch (thin) the enclosed portion 27. The enclosed portion 27 is deformed into an undulating profile 280 (see FIG. 10).

In a further embodiment, a single stretch punch 35 has a number of relief features in the form of recesses/cut-outs 353 provided in its end face (see FIG. 11). In the embodiment shown in FIG. 11, there is a central recess/cut-out surrounded by a single annular recess/cut-out. However, alternative configurations of recess/cut-out may be used.

(Re-)Drawing Operation on Stretched Cup

For the embodiment of the invention shown in FIGS. 6*a* and 6*b*, the stretched cup with its thinned and domed region 28 in the base is transferred to a bodymaker assembly 40 (see FIGS. 12*a* to 12*d*). The bodymaker assembly 40 comprises two halves 41, 42 (indicated by arrows in FIGS. 12*a* to 12*d*).

The first half 41 of the bodymaker assembly 40 has a tubular re-draw punch 43 mounted on the same axis as circumferential clamp ring 44. As can be seen from FIGS. 12*a* to 12*d*, the clamp ring 44 circumferentially surrounds the re-draw punch 43 like a sleeve. As will be understood from the following description and looking at FIGS. 12*a* to 12*d*, the re-draw punch 43 is moveable through and independently of the circumferential clamp ring 44.

The second half 42 of the bodymaker assembly 40 has a re-draw die 45. The re-draw die 45 has a tubular portion having an outer diameter corresponding to the internal diameter of the stretched cup 23 (see FIG. 12*a*). The re-draw die 45 has a forming surface 46 on its inner axial surface, which terminates in an annular end face 47 (see FIGS. 12*a* to 12*d*). The annular end face 47 of the re-draw die 45 corresponds in width to that of the annular region 26 on the base of the stretched cup.

In use, the stretched cup 23 is first mounted on the re-draw die 45 (as shown on FIG. 12*a*). Then, as shown in FIG. 12*b*, the two halves 41, 42 of the bodymaker assembly 40 are moved axially relative to each other so that the annular region 26 of the base of the stretched cup is clamped between the annular end face 47 of the re-draw die 45 and the surface of the circumferential clamp ring 44.

Once clamped, the re-draw punch 43 is then forced axially through the clamp ring 44 and the re-draw die 45 (see arrow A on FIGS. 12*c* and 12*d*) to progressively re-draw the material of the stretched cup along the forming surface 46 of the re-draw die. The use of the re-draw punch 43 and die 45 has two effects:

i) to cause material from the sidewall 24 to be drawn radially inwards and then axially along the forming surface 46 of the re-draw die 45 (as indicated by arrows B on FIGS. 12*c* and 12*d*). In this way, the cup is reduced in diameter (as indicated by comparing FIG. 12*a* with FIG. 12*d*); and ii) to cause the stretched and thinned material in the domed region 28 of the base to be progressively pulled out and transferred from the base into the reduced diameter sidewall (as indicated by arrows C on FIGS. 12*c* and 12*d*). This has the effect of flattening the domed region 28 of the base (see especially FIG. 12*d*).

FIG. 12*d* shows the final state of the re-drawn cup 23 when the re-draw punch 43 has reached the end of its stroke. It can clearly be seen that the formerly domed region 28 of the base has been pulled essentially flat, to provide a cup or container body 23 where the thickness of the base 25 is thinner than that of the ingoing blank 21. As stated earlier, this reduced thickness in the base 25—and the consequent weight reduction—is enabled by the stretching operation performed previously.

As shown in the detail view of the re-draw die 45 in FIG. 13, the junction between the forming surface 46 and the annular end face 47 of the re-draw die 45 is provided with a radius $R_{45}$ in the range 1 to 3.2 mm. The provision of a radius $R_{45}$ alleviates the otherwise sharp corner that would be present at the junction between the forming surface 46 and the annular end face 47, and thereby reduces the risk of the metal of the stretched cup 23 tearing when being re-drawn around this junction.

The re-drawing stage illustrated in FIGS. 12*a* to 12*d* may also be followed by one or more further re-drawing stages to induce a further reduction in diameter of the cup 23.

Note that although FIGS. 12*a* to 12*d* show use of a tubular re-draw punch 43 having an annular end face, the punch may alternatively have a closed end face. The closed end face may be profiled to press a corresponding profile into the base of the cup.

The drawing operation described above and illustrated in FIGS. 12*a* to 12*d* is known as reverse re-drawing. This is because the re-draw punch 43 is directed to invert the profile of the stretched cup. In effect, the re-draw punch reverses the direction of the material and turns the stretched cup inside out. This can be seen by comparing the cup profiles of FIGS. 12*a* and 12*d*. Reverse re-drawing the cup in this context has the advantages of:

i) preventing uncontrolled buckling of the domed region 28 of the base of the stretched cup (especially when using a re-draw punch having a closed end face); and ii) maximising transfer of material from the domed region 28 to the sidewalls 24.

Note that although the embodiment shown in FIGS. 12*a* to 12*d* illustrates reverse re-drawing, conventional re-drawing would also work; i.e. where the re-draw punch acts in the opposite direction to reverse re-drawing and does not turn the cup inside out.

FIG. 14 shows the changes undergone by the metal blank 21 from:

a) before any forming operations have been undertaken, to b) forming into the first stage cup in the cupping press 10, to c) the stretching and thinning operation performed in the stretch rig 30, to d) the re-drawn cup that results from the bodymaker assembly 40.

A location on the stretched and thinned domed region 28 of the stretched cup is indicated as X in view c of FIG. 14. The figure illustrates the effect of the re-drawing operation in radially pulling out the material at X (view c) to X' (view d). The figure shows that the base of the cup at that location after stretching ($t_{stretch}$) (and after the re-drawing operation) has a reduced thickness relative to the ingoing gauge of the blank 21 ($t_{in\text{-}going}$), i.e. $t_{stretch}<t_{in\text{-}going}$. As previously stated, this thinning of the base is enabled by the stretching operation.

To maximise the height of the sidewall 24 of the cup with its thinned base, the re-drawn cup may also undergo ironing of the sidewalls by being drawn through a succession of ironing dies (not shown) in an ironing operation. This ironing operation has the effect of increasing the height and decreasing the thickness of the sidewall, and thereby maximising the enclosed volume of the cup.

FIG. 15 shows a container 100 where the final resulting cup 23 has undergone such an ironing operation to form container body 110. The container body 110 is flared outwardly 111 at its access opening. Can end 120 is provided with a seaming panel 121, the seaming panel enabling the can end to be fastened to the container body by seaming to the flared portion 111.

The invention claimed is:

1. A method for manufacture of a metal cup, the method comprising the following steps:

clamping an annular region on either or both of a sidewall and of a base of the cup to define an enclosed portion which includes all or part of the base, the base and sidewall of the cup being integral and formed of a metal sheet;

deforming and stretching at least some of the enclosed portion to thereby increase the surface area and reduce the thickness of the base, the annular clamping restricting or preventing metal flow from the clamped region into the enclosed portion during this deforming and stretching step; and after the deforming and stretching step, drawing the cup to pull and transfer outwardly material of the stretched and thinned base into the sidewall.

2. A method as claimed in claim 1:

wherein the annular clamping of the deforming and stretching step comprises using one or more clamping elements having a clamping face, the clamping face having a textured surface.

3. A method as claimed in claim 1, wherein the annular clamping is performed by clamping opposing surfaces of either or both the sidewall and the base of the cup between corresponding opposing first and second clamping elements, each of the first and second clamping elements having a clamping face with geometric discontinuities to thereby assist in disrupting the flow of the metal of the cup between the first and second clamping elements as the deforming and stretching step is performed.

4. A method as claimed in claim 3, wherein the geometric discontinuities comprise any one of:

i. the clamping face of the first clamping element having one or more beads, ridges or steps which, in use, urge metal of the clamped annular region within corresponding one or more relief features in the clamping face of the second clamping element; or ii. the clamping face of the second clamping element instead having one or more beads, ridges or steps which, in use, urge metal of the clamped annular region within corresponding one or more relief features instead in the clamping face of the first clamping element; or iii. a combination of (i) and (ii).

5. A method as claimed in claim 4, wherein the first and second clamping elements are adapted such that, in use, the one or more beads, ridges or steps in the clamping face of the first or second clamping element urge metal of the clamped annular region so as to be wholly enclosed by and within the corresponding one or more relief features in the corresponding clamping face of the second or first clamping element.

6. A method as claimed in claim 1:

wherein the deforming and stretching step comprises moving either or both of a stretch punch and the cup toward each other so that the stretch punch deforms and stretches the at least some of the enclosed portion.

7. A method as claimed in claim 6, wherein the stretch punch comprises an end face having one or more relief features.

8. A method as claimed in claim 6, wherein the stretch punch comprises a punch assembly, the assembly comprising a first group of one or more punches opposing one surface of the enclosed portion and a second group of one or more punches opposing the opposite surface of the enclosed portion, the deforming and stretching step comprising moving either or both of the first and second groups towards each other to deform and stretch the at least some of the enclosed portion.

9. A method as claimed in claim 1, further comprising an initial drawing step performed before the deforming and stretching step, the initial drawing step comprising drawing a metal sheet to form the cup.

10. A method as claimed in claim 1, wherein the drawing step comprises or is followed by a step of ironing the cup.

11. A method as claimed in claim 1 wherein the drawing step reduces a height of a dome formed during the deforming and stretching step by pulling and transferring material of the stretched and thinned base.

12. An apparatus for manufacture of a metal cup, the apparatus comprising:

a clamping tooling adapted to clamp the cup formed of a metal sheet, the cup having a sidewall and an integral base, the clamping tooling adapted to clamp an annular region on either or both the sidewall and the base to define an enclosed portion which includes all or part of the base;

a stretch tool adapted to deform and stretch at least some of the enclosed portion in a stretching operation to thereby increase the surface area and reduce the thickness of the base, the clamping tooling further adapted to restrict or prevent metal flow from the clamped region into the enclosed portion during this stretching operation; and tooling for drawing the cup, the drawing tooling adapted to pull and transfer outwardly material of the stretched and thinned base into the sidewall.

13. An apparatus as claimed in claim 12, wherein the clamping tooling is adapted to clamp an annular region on the base of the cup.

14. An apparatus as claimed in claim 12, wherein the clamping tooling comprises a clamping element having a clamping face, the clamping face having a textured surface.

15. An apparatus as claimed in claim 12, wherein the clamping tooling comprises a first clamping element and a second clamping element, the first and second clamping elements adapted to clamp opposing surfaces of either or both the sidewall and the base of the cup, each of the first and second clamping elements having a clamping face with geometric discontinuities to thereby assist in disrupting the flow of the metal of the cup between the first and second clamping elements as the stretching operation is performed.

16. An apparatus as claimed in claim 15, wherein the geometric discontinuities comprise any one of:

i. the clamping face of the first clamping element having one or more beads, ridges or steps which, in use, urge metal of the clamped annular region within corresponding one or more relief features in the clamping face of the second clamping element; or ii. the clamping face of the second clamping element instead having one or more beads, ridges or steps which, in use, urge metal of the clamped annular region within corresponding one or more relief features instead in the clamping face of the first clamping element; or iii. a combination of (i) and (ii).

17. An apparatus as claimed in claim 16, wherein the first and second clamping elements are adapted such that, in use, the one or more beads, ridges or steps in the clamping face of the first or second clamping element urge metal of the clamped annular region so as to be wholly enclosed by and within the corresponding one or more relief features in the corresponding clamping face of the second or first clamping element.

18. An apparatus as claimed in claim 12, wherein the stretch tool comprises a stretch punch, the apparatus adapted to move either or both of the stretch punch and the cup toward each other so that, in use, the stretch punch deforms and stretches at least some of that part of the base which lies within the enclosed portion.

19. An apparatus as claimed in claim 18, wherein the stretch punch has an end face with a non-planar profile, the apparatus adapted to move either or both of the stretch punch and the cup toward each other so that, in use, the stretch punch deforms and stretches at least some of that part of the base which lies within the enclosed portion into a corresponding non-planar profile.

20. An apparatus as claimed in claim 18, wherein the stretch punch comprises an end face having one or more relief features.

21. An apparatus as claimed in claim 18, wherein the stretch punch comprises a punch assembly, the assembly comprising a first group of one or more punches opposing one surface of the enclosed portion and a second group of one or more punches opposing the opposite surface of the enclosed portion, the first and second groups moveable towards each other to, in use, deform and stretch at least some of that part of the base which lies within the enclosed portion.

22. An apparatus as claimed in claim 12, the apparatus further comprising tooling adapted to initially drawing a metal sheet to form the cup for the stretching operation.

23. An apparatus as claimed in claim 12, further comprising tooling for ironing the cup.

24. An apparatus as claimed in claim 12, wherein the drawing tooling is adapted to reduce a height of a dome formed by the stretch tool by pulling and transferring material of the stretched and thinned base.

* * * * *